US005772614A

United States Patent [19]

Lindquist

[11] Patent Number: 5,772,614

[45] Date of Patent: Jun. 30, 1998

[54] BACK MASSAGE DEVICE USABLE WITH LEG ELEVATION

[76] Inventor: Edward E. Lindquist, 2731 Citron Dr., Longwood, Fla. 32779

[21] Appl. No.: 674,396

[22] Filed: Jul. 2, 1996

Related U.S. Application Data

[63] Continuation-in-part of Ser. No. 213,036, Mar. 15, 1994, abandoned.

[51] Int. Cl.[6] ..... A61H 15/00

[52] U.S. Cl. ..... 601/116; 601/123; 601/125; 601/128

[58] Field of Search ..... 601/115–6, 122–3, 601/125–8, 131; 482/96

[56] References Cited

U.S. PATENT DOCUMENTS

| | | | |
|---|---|---|---|
| 1,572,794 | 2/1926 | Hamilton | 601/122 X |
| 2,619,957 | 12/1952 | Hague | 601/122 |
| 4,193,394 | 3/1980 | Everett et al. | 601/115 X |
| 5,352,188 | 10/1994 | Vitko | 601/115 X |
| 5,634,887 | 6/1997 | Fortier | 601/115 |

FOREIGN PATENT DOCUMENTS

| | | | |
|---|---|---|---|
| 74204 | 11/1960 | France | 601/122 |
| 3312060 | 10/1984 | Germany | 601/116 |
| 1662556 | 7/1991 | U.S.S.R. | 601/115 |
| 1695921 | 12/1991 | U.S.S.R. | 601/122 |

*Primary Examiner*—Danton D. DeMille
*Attorney, Agent, or Firm*—Julian C. Renfro, Esq.

[57] ABSTRACT

A back massage and exercise device comprising a substantially flat, elongate frame able to be utilized on a supporting surface, with the frame having a pair of long sides joined together by a pair of short sides and being several times as long as it is wide. A roller array in the form of a parallel series of elongate rollers are loosely mounted in a spaced apart, operational relationship between the long sides of the frame. The frame has an operative position in which a lower portion of substantially all of the rollers is in contact with the supporting surface, with an upper portion of the rollers being available for directly supporting the body of a user. The user is able to readily bring about back and forth rolling movement of the frame along the supporting surface at such time as he is lying on the rollers, with the motion of the upper portions of the rollers during such movement of the frame bringing about a massaging action to the portion of the user's body in contact with the rollers. At least one of the rollers is of significantly larger diameter than the other rollers of the array, with the larger diameter roller operatively mounted so as to be contacted by the user's head. Significantly, the larger diameter roller is employable by the user for head, neck and shoulder massage.

58 Claims, 7 Drawing Sheets

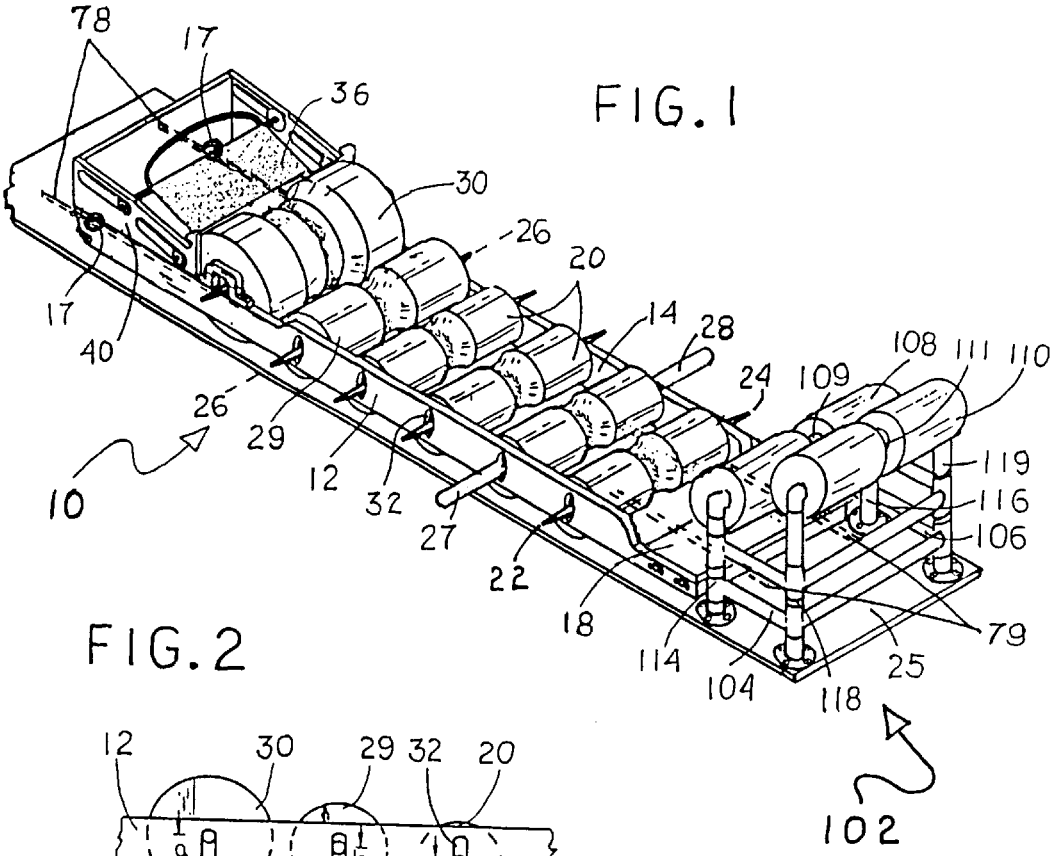
FIG. 1
FIG. 2
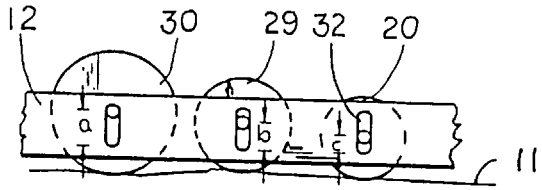
FIG. 3
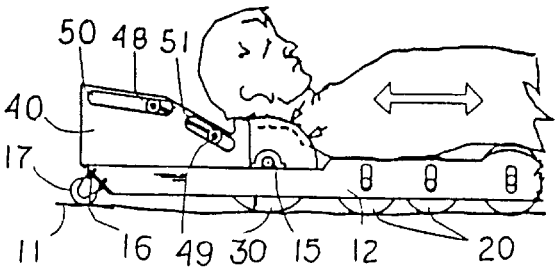
FIG. 4
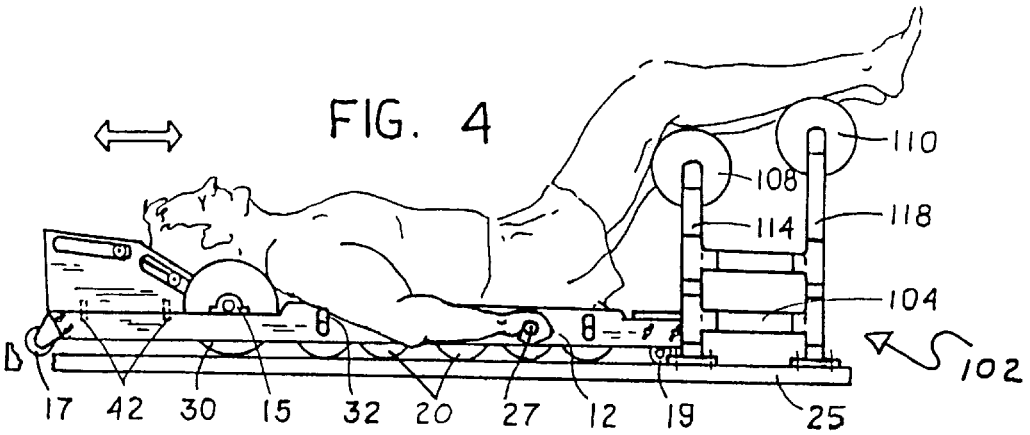

FIG. 8
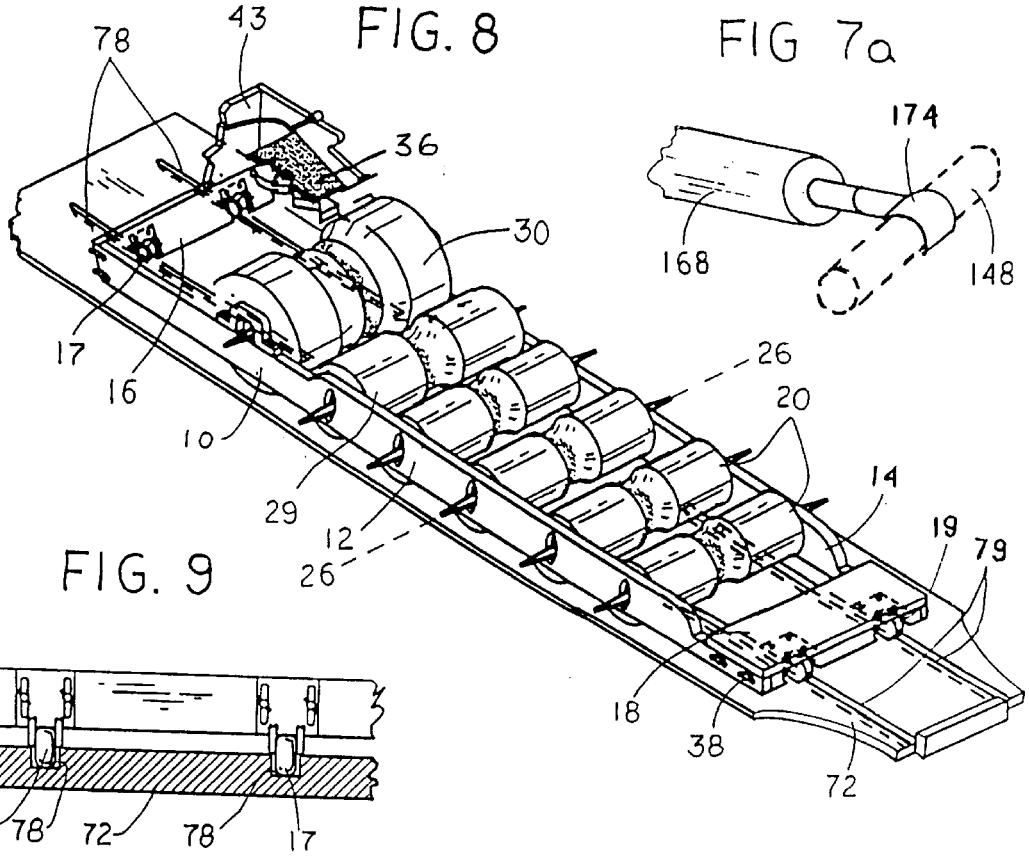
FIG 7a
FIG. 9
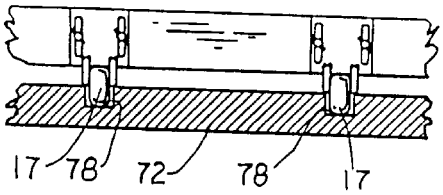
FIG. 10a
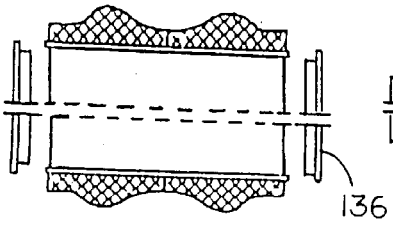
FIG. 10b
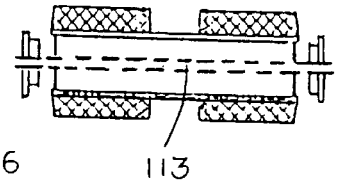
FIG. 10c
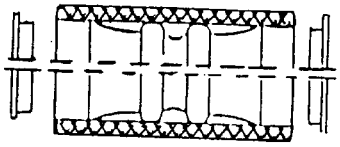
FIG. 11a
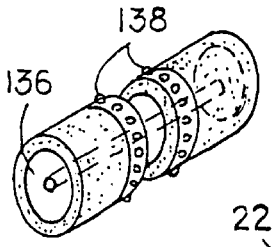
FIG. 11b
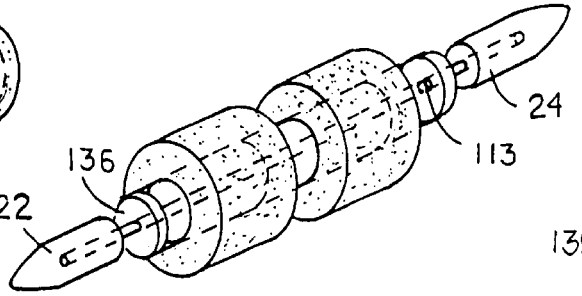
FIG. 11c
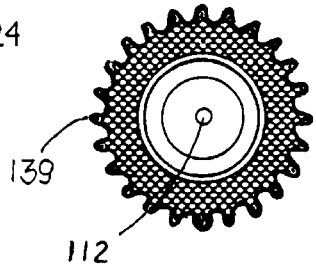

FIG. 23
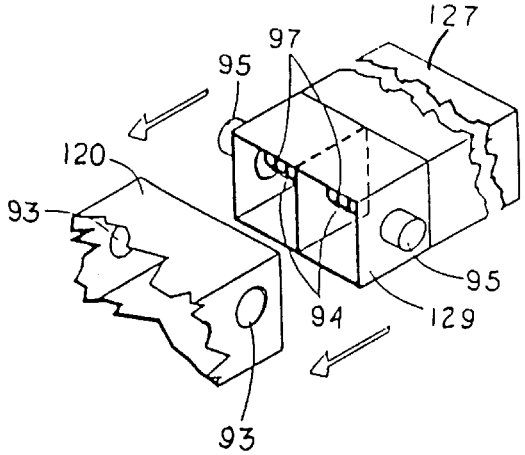
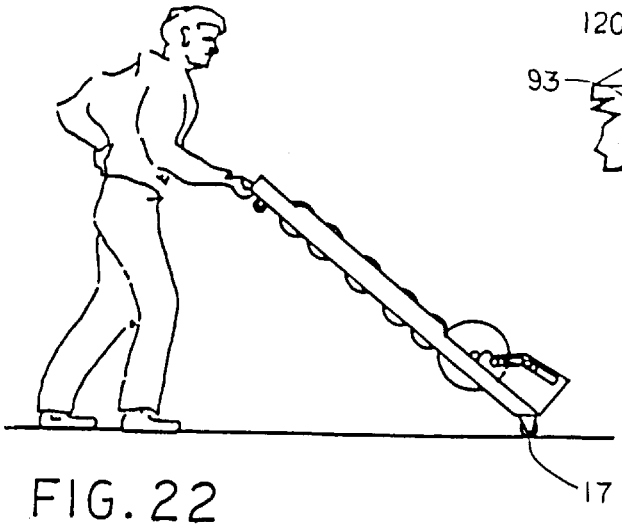
FIG. 22
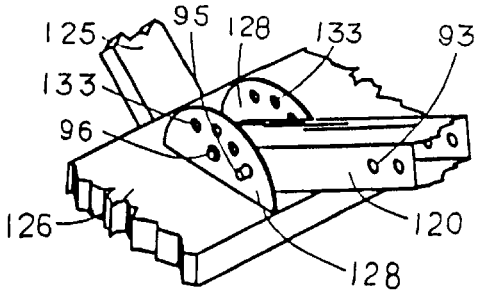
FIG. 24a
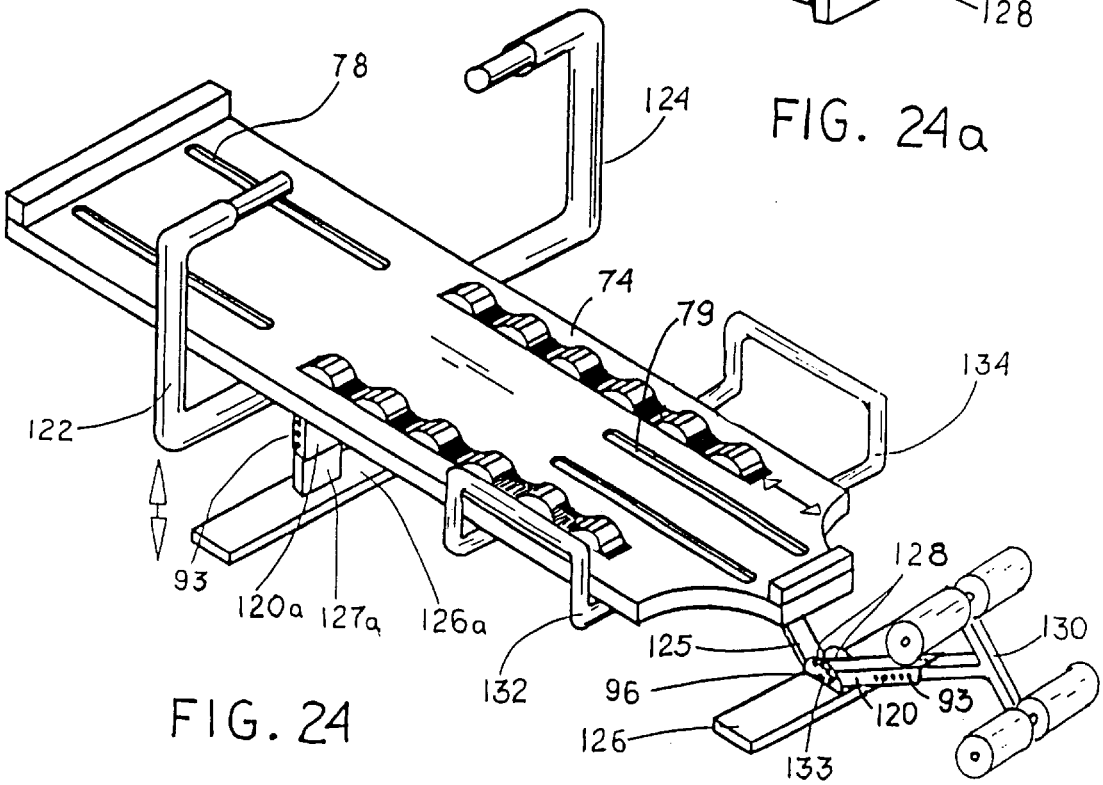
FIG. 24

BACK MASSAGE DEVICE USABLE WITH LEG ELEVATION

RELATIONSHIP TO EARLIER INVENTION

This invention may be regarded as a Continuation-in-Part of my application entitled "Back Massage and Exercise Device," Ser. No. 08/213,036, filed Mar. 15, 1994, which is abandoned.

BACKGROUND OF THE INVENTION

1. Field of the Invention

This invention relates to a massaging device upon which a user can lie, and more specifically to a massaging device utilizing a multiplicity of generally cylindrically-shaped rollers mounted in a frame, which frame is usable either on the floor or, preferably, upon a specially configured supporting surface.

2. Description of the Prior Art

The Hoard U.S. Pat. No. 1,265,083 entitled "MASSAGE APPLIANCE" issued May 7, 1918 was one of the early patents pertaining to neck massage, and it involves an arrangement in which a user lying on a flat sheet member causes a relatively small pair of rollers disposed in a spaced-apart relationship can be made to move up and down the back of the head, neck and upper spine as a consequence of a supine user manipulating a pair of widely spaced handles.

The Wentz U.S. Pat. No. 1,643,040 entitled "MASSAGE MACHINE" issued Sep. 20, 1927 and teaches a device involving a table mounted on a standard or fulcrum about which it is free to pivot and involving a pair of parallel frame members between which are mounted a series of rollers having their axis in a common plane. The arrangement is such that upon the user placing the table at an angle and then lessening his grip on handrails, he will slide down over the rollers and thus massage the part of his body in contact with the rollers. The surfaces of the rollers are out of contact with any supporting surface.

The Morrison U.S. Pat. No. 3,645,256, which issued Feb. 29, 1972, teaches a device in which each roller is made up of a series of thick discs of semihard rubber, that are assembled in stacked, coaxial relation on a rigid mandrel or the like. A plurality of such rollers may be used in a simple frame upon which the user can lie, but this device is obviously expensive to make and uncomfortable to use.

The Morini et al U.S. Pat. No. 3,705,579 entitled "MASSAGE DEVICE" which issued Dec. 12, 1972 does not involve a roller frame at all, but rather teaches a type of bobbin having a narrowed central portion. The user is intended to interpose this device between his back and a flat surface, so upon the user moving his back parallel to the flat surface, the massage device is said to manipulate the back muscles of the user.

The Crivello et al U.S. Pat. No. 4,583,731 entitled "SPINAL EXERCISING APPARATUS" which issued Apr. 22, 1986 involves an angularly adjustable table, adjacent one end of which is a resistive force mechanism to receive the head of the user, and then to provide a substantially uniform opposing force throughout a selected range of arcuate exercising motions. The Crivello et al device does not utilize a series of rollers.

It is well known in the art to provide self-powered back massage devices, and an example of this is U.S. Pat. No. 4,688,556 issued to Moreau A. Keller, Jr. on Aug. 25, 1987. The Keller device uses a plurality of rollers in the nature of yielding oblate spheroids that are preferably inflated and rotatably held in a parallel relationship in a support frame. It is upon the upper surfaces of these oblate spheroids that the user is intended to lie and bring about massage of his or her back as he or she uses his or her leg muscles to cause the device to move back and forth on a support surface. The Keller device is obviously of marginal value to the average user, for his yielding oblate spheroids are necessarily expensive to manufacture and to maintain, and they are of a size such that only a limited number of such components could be accommodated in a frame of reasonable proportions. Also, his oblate spheroids could not be readily exchanged for components of a somewhat different configuration, size or consistency.

The Vitko U.S. Pat. No. 5,352,188 entitled "COMBINED BACK AND NECK STIMULATOR AND REHABILITATION DEVICE" issued Oct. 4, 1994 and involves a small frame utilizing a plurality of axles disposed in a parallel relationship, with a plurality of balls rather than generally cylindrically-shaped rollers disposed on each axle. It is well known that deep massage by a physical therapist or a masseur over a painful trigger point in the back can sometimes lessen painful local muscle spasms in mild and moderate cases of back pain, and a ball is sometimes used for deep pressure over specific trigger points. However, the use of a plurality of randomly placed balls upon which a user is to lie amounts to a less than comfortable arrangement, with discomfort being in effect acknowledged by Vitko in Column 5, line 22 of his Specification, at which location he points to the use of an optional back pad 50 (FIG. 1A) to decrease pressure of roller balls on the backs of sensitive users. In addition, the use of the random series of balls, such as those provided by Vitko, are very unlikely to be successful in treating specific trigger points. Furthermore, should a user of the Vitko device find it to be uncomfortable, he or she will tend to contract his or her back muscles, thus making the massage counterproductive.

The German patent to Schuler, Patent No. DE4101 971 A1, teaches a pair of massage rollers each carrying several toruses along their rotary axis, with these toruses supposedly being placed on their axis at locations corresponding to the main points of reflex zones associated with acupuncture massage.

The Cagle U.S. Des. Pat. No. 348,519 entitled "BACK MASSAGER" illustrates a roller frame of a type that can be used in a flattened condition, and then after use it can be moved into a generally pyramidally-shaped storage position. Being a design patent, the patentee does not explain the use of his device.

It was in an effort to overcome the shortcomings of these and other such devices that the present invention was evolved.

SUMMARY OF THIS INVENTION

A back massage and exercise device in accordance with this invention comprises a substantially flat, elongate frame of generally rectangular configuration, such frame having long side members and typically being several times as long as it is wide. A series of elongate rollers of generally cylindrical shape are operatively mounted in a spaced, parallel relationship along the length of the frame, with the frame being able to be utilized either on a flat, substantially horizontally disposed supporting surface, or else preferably on an inclined supporting surface. A series of vertical slots are disposed in a spaced array along each of the long sides of the frame, with the slots in one long side being in alignment with the slots in the other long side. The parallel series of elongate, generally cylindrically-shaped rollers are operatively mounted in these slots and serve directly as a support for the person using the frame. Each of the rollers has a longitudinal axis about which it is rotatable, and each of the rollers has an axial length at least twice its diameter.

An axle member protrudes for a limited extent from each end of each roller. Each axle member is disposed along the longitudinal axis of the respective roller, with the end of each axle member tightly fitting into a spindle or support shaft. Each spindle or support shaft extends in a non-binding manner through a respective slot of the frame.

The frame has an operative position in which a lower portion of all of the rollers is in contact with the supporting surface, with an upper portion of the rollers being available for directly supporting the body of the user. The user of my device is thus able to readily bring about movement of the frame along the supporting surface, at such time as he or she is lying on the rollers, with the motion of the upper portions of the rollers during movement of the frame bringing about a comfortable, highly desirable massaging action to the portion of the user's body in contact with the rollers.

My novel elongate frame of generally rectangular configuration is preferably utilized on a special supporting surface that is suitably inclined and which contains multi-mode options which may be chosen by the user to enhance the massage. One desirable option is the use of the inclined supporting surface in concert with leg supporting rollers which maintain the legs of the user in an elevated position, thus to cause the user's back to be in an improved relationship to the rollers of the elongate frame. This and other options will be discussed later in further detail.

Advantageously, a member on one of the long sides of the frame can be loosened, such that at the option of the user, one or more of the rollers can be removed from the frame, and rollers of a different characteristic or size substituted.

I prefer for a mid portion of each roller to be of reduced diameter, such that when the user is lying supine in a centered position on the rollers, the user's spinal column is, quite advantageously, not in direct contact with the hard inner core of any of the rollers.

At least one of the rollers may be of significantly larger diameter than the other rollers of the frame, with this larger diameter roller being employable by the user for head, neck and shoulder massage.

The novel, generally rectangular roller frame in accordance with this invention is readily adaptable for use by persons who are short, of medium height, or tall. In order to accommodate persons of different body lengths, the person uses the largest roller positioned between the neck and shoulders as a point of reference. If the user is tall, his or her torso will extend further toward the foot end of the device. If the user is short, his or her torso will not extend as far.

OBJECTS OF THE INVENTION

It is a primary object of my invention to provide a back massage and exercise device largely made up of a series of generally cylindrically-shaped rollers loosely contained in a parallel relationship in an elongate frame, which rollers can provide an effective back massage to the user's back, head and neck muscles at such time as the user is lying in a supine position on the rollers, and the frame is caused to move in a back and forth manner along a supporting surface.

It is another object of my invention to utilize a back massage and exercise device of inexpensive yet effective construction, largely made up of a series of aligned rollers of generally cylindrical construction, with the lower surface of such rollers traveling in back and forth movements along a supporting surface, and with the upper surface of such rollers of the roller array serving to provide highly effective massage to the back, head and neck and shoulder muscles of the user.

It is another object of my invention to provide a back massage and exercise device in which one roller of the device is considerably larger than the other rollers in the array, which serves to support and massage the head, neck and shoulders of the user.

It is yet still another object of my invention to provide a back massage and exercise device in which rollers of at least two distinctly different diameters can be utilized at a given time in an elongate frame upon which a user can lie.

It is yet still another object of my invention to provide a multi-mode massage device that guards against neck muscle strain by the use of a novel head rest operative in conjunction with a large roller utilized adjacent the head end of my novel device.

It is another object of my invention to provide a multi-mode back massage and exercise device that is optionally usable on an ordinary flat supporting surface, or on a special supporting surface that is suitably inclined, being comfortable and easy for the user to mount and protecting the user from dizziness, which may be a problem for some users when a device of this type is used on a flat surface.

It is another object of my invention to provide a leg elevating device which is attached to the framework of the inclined supporting surface, functioning to cause the user's pelvis to tilt upward, thus elongating the spaces between the user's vertebrae, resulting in the relief of muscle tension as the user gently rolls back and forth over the padded rollers.

It is yet still another object of my invention to provide a novel back massage device incorporated into a frame in which rollers of a novel roller array can provide an effective back massage to the user's back muscles at such time as the user is lying in a supine position on the rollers, in addition to which the user can obtain arm exercise and/or leg exercise as well.

It is yet still another object of this invention to provide a back massage and exercise device in which a somewhat larger roller is mounted separately from the other rollers of the frame, with handles easily grasped by the user being located on each side of the frame, to enable the user to move this larger roller for some distance in opposition to the other rollers of the frame, thus to provide a particularly effective shoulder massage for the benefit of the user.

It is yet still another object of this invention to provide a back massage and exercise device usable in a multi-mode manner on a special supporting surface that may be inclined, or that may be of undulating configuration, or else some combination of inclined with undulations.

It is yet still another object of this invention to provide a back massage and exercise device usable in a multi-mode manner on a special supporting surface that may be of undulating configuration, with the peaks and valleys on one side of the supporting surface being either in phase or out of phase with the peaks and valleys of the other side of the supporting surface.

It is yet still another object of my invention to provide a roller-accommodating frame whose length may accommodate persons who are short, of medium height, or tall.

It is a yet further object of my invention to provide a back massage and exercise device utilizing a series of rollers loosely contained in an elongate frame, with it being readily possible for the user to substitute rollers of a different size, hardness or other characteristic, in place of the initially selected set of rollers.

It is yet still another object of my invention to provide a novel, multi-mode back massage device incorporated into a frame that may be easily rolled from a location of use to another location.

These and other objects, features and advantages will be more apparent as the description proceeds.

BRIEF DESCRIPTION OF DRAWINGS

FIG. 1 is a perspective view of a basic embodiment of my novel back massage and exercise device, this figure showing an elongate frame in which a plurality of generally cylindrically-shaped rollers are mounted in a parallel relationship, with this figure also revealing the use of the frame in conjunction with a device utilizing a plurality of leg-contacting rollers being mounted on a flat support member, with suitable guide means being employed to keep the frame centered on the support member during use;

FIG. 2 is a fragmentary view revealing how various sizes of rollers can reside in different portions of the vertically elongate mounting slots located in the long side member visible in this figure, as well as in the long side member not visible herein, with this arrangement preventing one roller making undesirable contact with another roller;

FIG. 3 is a fragmentary view generally relatable to FIG. 2 and showing the use of a large head roller, with which the user may make particular use for the purpose of head, neck and shoulder massage, with it to be noted that I may utilize a head supporting device in conjunction with the large roller, to keep the user's neck from hyperextending;

FIG. 4 is a side elevational view revealing a typical usage of my novel massage and exercise device, with this figure further revealing the use of one embodiment of a novel leg elevation device responsible for causing the user's legs to be disposed in a position aiding the effective massage of the user's lower back muscles by the rollers of my novel elongate frame, with this view yet further illustrating the user moving the massage device back and forth by the use of the large handles;

FIG. 7*a* is a fragmentary view to a larger scale showing a hook-shaped member of the type provided at the end of each of the leg-contacting roller devices utilized on the frame depicted in FIGS. 5 through 7, with this hook-shaped member enabling the leg-contacting roller devices to be deployed in an active position;

FIG. 8 is a perspective view similar to FIG. 1, but without the leg supporting device, with this view showing my novel elongate frame operatively mounted on a flat support member of the general type depicted in FIGS. 5 through 7, with the guide means utilized for maintaining the elongate frame in an operative relationship to the flat support member being apparent;

FIG. 9 is a cross-sectional view from the head end of my device, revealing in greater detail the guide means in the form of supporting wheels or casters on the elongate frame that interact with the sets of parallel grooves provided in the flat support member;

FIG. 10*a* shows a cross sectional view of a roller shaped to receive the user's head and massage the shoulders, which roller is provided with end caps such that a steel axle may be received therethrough, with it to be understood that a roller of this type is typically about twice as long as its diameter;

FIG. 10*b* shows a cross sectional view of a typical, generally cylindrical roller with a soft covering over each end of the roller, with this configuration being such that the recessed mid portion of the roller will not likely come into contact with the user's spine, with it to be understood that a roller of this type is typically of a length two to three times its diameter;

FIG. 10*c* is a cross sectional view of a generally cylindrical roller that is uniquely shaped in that it is tapered toward the narrower mid portion of the roller, with circularly-shaped protrusions utilized on either side of the mid portion of the roller serving the purpose of massaging the muscles which support the spinal column, with this roller being particularly applicable for use on the upper and middle back;

FIG. 11*a* is a perspective view of a novel roller in accordance with this invention in which a removable elastic band containing a row of uniformly-shaped protrusions is located on each side of the recessed mid portion of the roller, with these protrusions serving to provide stimulation to trigger points located along each side of the user's spine;

FIG. 11*b* shows a detailed perspective view of a generally cylindrical roller similar to FIG. 10, with a plastic insert on each end of the roller being provided with a small center hole for accommodating the steel axle, which axle is attached on each end to a spindle;

FIG. 11*c* shows an end view of a generally cylindrical roller with a latex covering featuring finger-like projections designed to give more stimulation to the user's skin during massage;

FIG. 22 reveals how the user may readily move my novel elongate, generally rectangular frame from one location to another, making use of a set of casters mounted in an inclined relationship at the head end of the elongate frame;

FIG. 23 is a fragmentary perspective view to a large scale with portions broken away to reveal internal construction of a pushbutton spring device, which device may be used at various sections or locations of a supporting framework in order to permit certain members of the framework to pivot or extend;

FIG. 24 is a view revealing the support member or slant board residing on a frame, with suitable adjustments available to the user such that the height of the head end of the support member as well as the position of the leg rest or leg elevation device usable therewith can be readily selected;

FIG. 24*a* is a fragmentary view to a comparatively large scale, showing details of the arrangement I prefer to utilize in permitting the user to adjust the positioning of the leg elevation device of FIG. 24;

DETAILED DESCRIPTION

Figure 5:
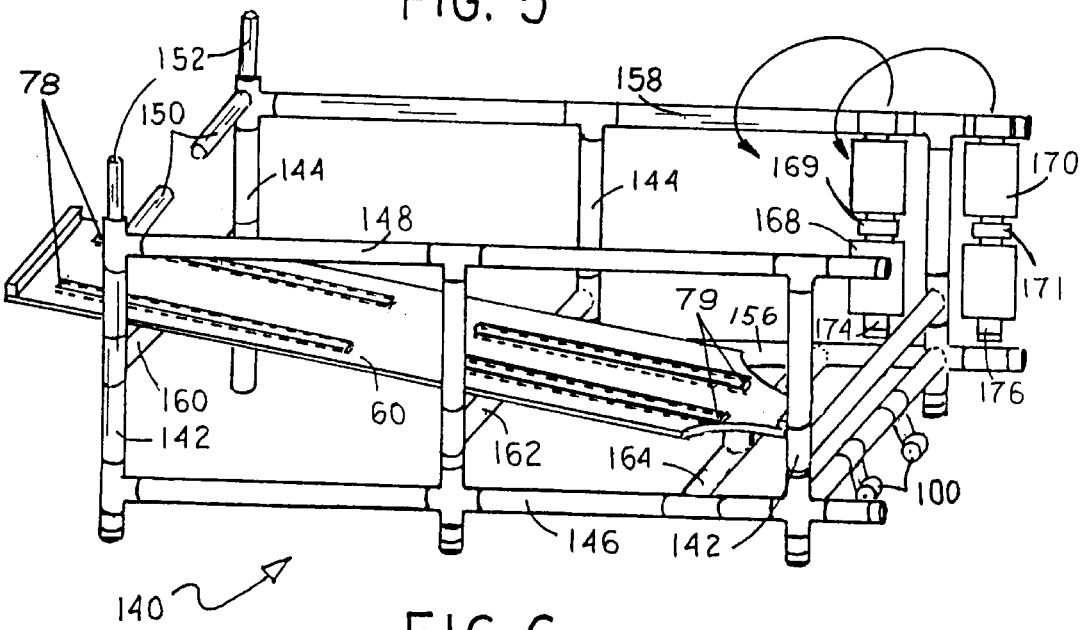
FIG. 5 shows an alternative embodiment of a leg elevation device, with this involving a lightweight frame usable in conjunction with my novel elongate roller frame, with the lightweight frame supporting multiple leg roller devices movable between "out-of-use" and "active" positions, and further revealing the use thereon of a slant board or supporting surface disposed in a slanted position.

With initial reference to FIG. 1, it will be seen that a back massage and exercise device in accordance with this invention comprises a substantially flat, elongate frame 10 of generally rectangular configuration, with the frame typically being several times as long as it is wide. In this instance, the frame 10 is being utilized on a mounting board 25, although in many instances the frame 10 may be utilized on the floor 11, as shown in FIGS. 2 and 3, or used on another type of flat supporting surface. It is to be understood that the elongate frame is able to undertake back and forth motion along the mounting board or other supporting surface when the device is in use.

From FIG. 1 it is to be seen that the frame 10 utilizes elongate members 12 and 14 representing the long members or side rails of the frame, which members are of equal length. End member 16 is utilized at the head end of the frame, with the member 16 being more clearly visible in FIG. 3. End member 18, visible in FIG. 1, is utilized at the opposite end of the frame, adjacent the location where the legs of the user may reside.

As will be discussed at length hereinafter, I utilize a series of wide, floor-contacting rollers 20 of substantially equal diameter, installed at spaced locations along the length of the members 12 and 14 of the frame. The rollers 20 are of generally cylindrical shape and typically are of a length that is two to three times their diameter. When a user is lying on the frame 10, his or her body will be in contact with the upper roller surfaces, which provide a highly satisfactory as well as comfortable and effective type of massaging action, whereas the lower roller surfaces are in contact with a mounting board or the floor. It will later be seen that my novel elongate frame can be used on other supporting surfaces than the mounting board 25, and such other surfaces can include a so-called slant board supported at a desired angle on a lightweight, upstanding frame.

With continuing reference to the construction of the frame 10, a series of vertically elongate slots 32, clearly visible in FIGS. 1, 2 and 4, are disposed in a spaced array along the elongate side rail 12 of the frame 10, and a series of identically positioned vertically elongate slots 34, not visible in these three figures, are disposed in a spaced array along the elongate side rail 14 of the frame. It is important to realize that the slots 32 in elongate side rail 12 are in careful alignment with the slots 34 located in the other long side of the frame, rail 14.

It is because of the carefully aligned relationship of the two sets of vertically elongate slots that the several wide rollers 20 of the roller array utilized in conjunction with my novel frame are enabled to reside in a parallel relationship. Because of the appropriate spacing of the elongate holes, one roller does not come into undesirable contact with another roller.

With further regard to a preferred embodiment of the elongate frame 10 illustrated in FIG. 1, the end members 16 and 18 of the frame 10 are secured adjacent respective ends of the elongate side rails 12 and 14, and these end members serve to complete a sturdy frame of generally rectangular configuration. The end member 16 is preferably disposed at approximately a 45° angle to the longitudinal plane of the frame 10, as shown in FIG. 3, with a symmetrically located pair of relatively small support wheels or casters 17 disposed in a spaced relationship on the underside of the end member 16. However only one wheel 17 is visible in some of the figures of drawing.

The reason for this angular mounting of the support wheels or casters 17 is that these wheels readily permit the elongate frame to be moved in the manner of a wheelbarrow from location to location, as depicted in FIG. 22. The support wheels or casters 17, along with the wheels 19 at the opposite end of the frame 10, assure a consistent height of the side rails 12 and 14 of the frame 10 above the mounting board 25, or the floor 11, or any other supporting surface. In the interests of providing stability to the frame 10, the wheels or casters of each pair of casters are disposed relatively far apart. A wheel 19 is visible in FIG. 4.

The angular mounting of the end member 16 is in contrast with the positioning of the end member 18 utilized opposite the head end of the frame in accordance with this first embodiment. This is true because the end member 18 is preferably disposed in a flat relationship, being located in the plane of the elongate frame 10. Thus, the end member 18 is typically of abbreviated height, to prevent any discomfort to the legs of the user. On the underside of the end member 18 are the previously-mentioned, symmetrically located pair of relatively small support wheels or casters 19. The wheels or casters 19 may be spaced somewhat more narrowly than the spacing of the support wheels 17.

The side rails 12 and 14 and end members 16 and 18 of the frame 10 may be made of a particularly strong wood, such as poplar, oak or maple, with poplar being preferred because it is less porous than oak. However, oak readily lends itself to a beautiful finish. In certain instances the side rails may be made of a light metal, such as aluminum, but as another alternative, the side rails may be made of fiberglass or an industrial grade plastic. Obviously I am not to be limited to the use of any one particular material in the construction of the sturdy frame 10.

As will be discussed hereinafter with regard to certain other figures of drawing, a guide means consisting of a pair of tracks or slots 78 may be provided at the head end of the mounting board 25 depicted in FIG. 1, and a pair of tracks or slots 79 may be provided near the opposite end of the mounting board. Because of the proper spacing of these pair of slots or grooves, respective ones of the small wheels utilized on the underside of the elongate frame 10 may move back and forth. More particularly, by the interaction of the relatively small wheels 17 with the tracks or slots 78 utilized at the head end of the mounting board, and the interaction of the relatively small wheels 19 with the tracks or slots 79 utilized at the opposite end of the mounting board, a guidance arrangement is created such that the frame 10 will be caused to maintain a desired alignment with the mounting board 25 at all times during use.

Also to be noted in FIG. 1 is a comparatively large roller 30, located adjacent the head end of the frame 10, which roller is typically utilized in conjunction with a head frame 40. These components will be discussed shortly.

Returning now to a further consideration of the previously mentioned relatively wide rollers 20 of approximately equal diameter, these rollers are operatively mounted in a somewhat loose parallel array in the elongate frame 10. More particularly, the several generally cylindrically-shaped rollers 20 are each preferably mounted on a steel axle 113 of the type depicted in FIGS. 10*b* and 11*b*. Upon the ends of each axle a pair of support shafts or spindles 22 and 24 are attached, in the manner revealed in FIG. 11*b*.

With reference back to FIG. 1, it will be seen that the spindles 22 and 24 are loosely mounted in the previously-mentioned vertically elongate slots 32 and 34 located in the side rails 12 and 14 of the frame 10. It is to be noted that if the user lying on the rollers of the elongate frame grasps spindle or support shaft 22 in one hand and spindle or support shaft 24 in the other hand, this will not impair desirable rotation of the respective roller 20 inasmuch as the roller can continue to rotate even though the steel axle 113 supporting that roller is restrained against rotation.

The rollers 20 in many instances have comparatively large inside diameters, as will be discussed hereinafter in connection with FIGS. 10*a* through 10*c*, which necessitates the utilization of an end cap 136 in each end of each roller. Each end cap is arranged to snap into the end of each roller and to be retained therein, with each end cap having a relatively small central hole, through which the previously-mentioned axle member 113 passes.

It is to be understood that the lower edges of these rollers are in contact with the floor 11 or other supporting surface, such as a slant board. The rollers 20 may be selected to have desired diameters and shapes as well as desired degrees of hardness, as will afterward be discussed, with the vertically elongate slots used in the side rails 12 and 14 permitting a range of roller diameters to be used. As previously indicated, the longitudinal spacing of the two sets of slots, slots 32 and 34, is such that the outer surface of one roller does not rub against the outer surface of adjacent rollers.

Although I can utilize generally cylindrically-shaped rollers 20 of a wide range of diameters, in one particular instance the rollers 20 were approximately 11 inches long, and had a nominal diameter of 4½ inches. As will be seen hereinafter, the rollers can have firm inner portions and relatively soft outer surfaces, so when in use, with a user lying on the rollers 20, the above-described rollers 20 may have what may be regarded as an effective diameter of approximately 4 inches. The rollers are large enough that the user's body clears the side rails when the user is lying on the rollers.

As will be discussed at some length hereinafter, I am not limited to the use of the relatively wide rollers 20 of a consistent size, but rather I may utilize rollers of varying diameter in my novel frame 10. Because the spaced array of slots 32 in the side member 12, and the spaced array of slots 34 in the side member 14 are elongate in the vertical direction, axle members associated with rollers of different diameter may be easily accommodated. The vertically elongate slots 32 and 34 permit quite a bit of relative motion of one roller from another, and I prefer to describe the rollers as being loosely mounted.

Continuing with a discussion of roller size, it will be seen from FIGS. 2 and 8 that roller 29 is somewhat larger than roller 20, and roller 30 is even larger than roller 29. In other words, the axle members of the several rollers at any given moment may reside in different vertical locations in the vertically elongate slots provided in the side rails 12 and 14. By the utilization of a roller 29 that is somewhat smaller than roller 30 but yet larger than the conventionally sized rollers 20, a highly effective massage of the shoulder area of the user's body can be brought about. As previously-mentioned with respect to FIG. 2, the vertically elongate slots I utilize in the elongate side members 12 and 14 are of such a dimension as not to inhibit vertical excursions of the axles of the rollers, and in addition, such slots permit rollers of different sizes to be intermixed in the frame 10.

In FIG. 3 it will be noted that the user's head is resting directly above the large roller 30, as a consequence of the user's body having been moved by contact with the rollers 20 along the frame 10 in the direction of the head end of the frame. This, of course, makes clear the fact that movements of the frame 10 along the supporting surface 11 enables a highly effective head and neck massage to be accomplished by virtue of a desirable amount of contact of these body portions with the comparatively large roller 30. In FIG. 4 it will be noted that the user's body has moved even further in the direction of the head end of the frame, thus to cause the user's neck portion to be directly supported by the large roller 30, with the head supported by an accompanying head rest 40. In this approximate position, the user can bring about a considerable amount of highly effective shoulder massage. The head rest 40, designed to prevent the user's neck from hyperextending in some instances, will be discussed at length hereinafter.

It is to be understood that the user is not required to utilize the large roller 30 in any particular manner, although many hours of utilization of my novel device have indicated that the large roller can be employed in a particularly effective manner by bringing such into contact with the muscles of the neck and shoulders, in the manner described hereinabove with reference to FIGS. 3 and 4 as well as hereinafter in conjunction with FIGS. 19*a* and 19*b*, and also with respect to FIG. 28.

It is to be understood with regard to the previously-mentioned elongate floor-contacting rollers 20 that each roller has a longitudinal axis 26—26 about which it is rotatable; note FIGS. 1 and 8. It is also to be understood that the axle members 113 with their respective spindles 22 and 24 are in each instance disposed along the longitudinal axis of the respective roller. As should now be clear, the spindles 22 and 24 operatively associated with each roller extend loosely into the respective vertical slots 32 and 34, so as not to inhibit the vertical movement of the roller therein. Because as previously mentioned, the vertically elongate slots of the two side members 12 and 14 are in careful alignment, all of the generally cylindrically-shaped rollers of the roller array utilized in my novel frame 10 necessarily reside in a substantially parallel relationship.

Although I am not to be limited to any particular roller construction, I may prefer to utilize one of the previously-mentioned steel axles 113 along the longitudinal centerline of each roller, with this arrangement using the steel shaft making it possible for the user to tightly grasp the very large handle members 27 and 28 depicted in FIG. 1 while he or she is lying on the rollers of the elongate frame 10, without inhibiting the rotation of the roller as it moves in contact with the supporting surface.

As is apparent from FIGS. 1 through 4, a comparatively large roller 30 may be utilized adjacent the head end of the frame 10, as previously mentioned. This large roller makes it readily possible for the user to obtain head, neck and shoulder massage by its utilization. In accordance with the embodiment depicted in the several mentioned figures, the relatively large roller 30 is held in a single location on the frame 10, being typically supported at equivalent locations on the upper surfaces of the side rails 12 and 14 by the use of U-shaped members 15 that are fastened to the side rails by the use of suitable screws or the like. I am not to be limited to this fixed location arrangement, however, for as will later be seen in connection with FIGS. 27 and 28, the axle members of the large roller 30*a* may be disposed in respective ones of a pair of elongate holes or slots 56 located in a pivotal frame 52 mounted adjacent the head end of my novel frame 10. This selectively movable mounting arrangement for the large roller 30*a* will later be discussed at greater length.

It is made quite apparent from FIG. 4 that the user of my novel device is readily able to bring about longitudinal movement of the frame 10 along the floor 11 or other supporting surface by the action of his or her arms. In FIG. 1 it is to be noted that I have provided large handles 27 and 28 in connection with one of the generally cylindrical rollers 20, which provides the user with grasping means for moving the elongate frame 10 with respect to the leg supporting device 102. The importance of the handles 27 and 28 is made quite apparent from FIG. 4, where it can be seen that a user lying on the rollers 20 can readily grasp these handles, and easily move the device back and forth without any effort from the user's legs, which may be resting on the rollers 108 and 110.

In an embodiment in which the handles 27 and 28 are used, I prefer to utilize the earlier-mentioned construction in which a central steel shaft extends the full dimension of the roller and well into the handle members themselves.

By this time it should be clear that at such time as a user is lying with his or her body in contact with the upper surface of the rollers 20, the rotative motion of the rollers during movement of the frame 10 along the floor 11 or other support surface brings about a highly desirable massaging action upon the portion of the user's body that is in contact with the upper surfaces of these rollers. The previously-mentioned support wheels 17 utilized on the underside of the end member 16, and the previously-mentioned support wheels 19 utilized on the underside of the end member 18 assure the frame 10 maintaining a level attitude during use, irrespective of the use of the relatively large roller 30 (or 30*a*) adjacent the head end of the frame 10. In other words, because of the effective utilization of the support wheels 17 and 19, height of the frame 10 above the floor 11 or other supporting surface will not be affected by the various diameters of the rollers that are from time to time selected to be mounted in the vertically elongate slots 32 and 34 of the frame 10.

Returning now to FIG. 1, it will be noted from the embodiment of my invention depicted in this figure that my novel elongate frame 10 is preferably utilized in concert with a leg supporting device 102 designed to reside on the same mounting board 25 as the elongate frame 10. FIG. 1 reveals that the horizontally disposed supporting members 104 and 106 of the device 102 are affixed to the mounting board 25, and reside in a spread-apart relationship. In the exemplary embodiment, the framework portion of the leg supporting device 102 was made of polyvinylchloride (PVC) tubing, but obviously I am not to be limited to this.

It will be further noted that the leg supporting device 102 involves a pair of generally cylindrical roller devices 108, independently rotatably mounted on elongate member 109, with this first set of roller devices 108 residing relatively near the elongate frame 10. The support member 109 is supported from vertically disposed members 114 and 116 that are in turn connected to the spaced apart supporting members 104 and 106 respectively.

A second pair of generally cylindrical roller devices 110, independently rotatably mounted on an elongate member 111, reside further from the frame 10, which roller devices are disposed in a slightly higher relationship with respect to the mounting board 25; note FIG. 4. It is to be understood that the horizontal support member 111 for the rollers 110 is supported by vertically disposed member 118, secured to member 104, and by vertically disposed member 119, secured to member 106. Suitable cross braces may be utilized in the interests of providing additional rigidity. Further details of the leg supporting device 102 will shortly be discussed at greater length. Because of its sturdy mounting on the mounting board 25, the leg supporting device 102 does not move or shift in an undesirable manner during use.

It is to be understood that the primary function of the leg supporting device 102 of FIGS. 1 and 4 is to bring about a pelvic tilt serving to flatten the lumbar region of the user's spine and thus facilitate the effective yet comfortable massage of the user's lower back area by the gentle movement of the rollers of the elongate frame 10.

It is to be noted that a like function is served by the leg-contacting roller devices 168 and 170 operatively associated with the relatively large frame discussed hereinafter in connection with FIGS. 5 through 7.

My novel frame 10 is not limited to usage on a flat supporting surface, but rather may be utilized in a multi-mode manner, as will subsequently be discussed.

With continued reference to FIG. 4 it is clear that the rollers 108 and 110 of the leg supporting device 102 are positioned so as to cause the lower legs of the user to be disposed in a somewhat upwardly inclined relationship, with the height of these rollers being such that the pair of rollers 108 can contact the lower thigh portion and the upper calf portion of the user's legs, whereas the pair of rollers 110 can contact the lower calf portions of the user's legs.

It is obvious from this arrangement that at the same time as the user's back is being massaged by the various rollers, including the relatively wide rollers 20 of standard size, the user's legs may readily move along rollers 108 and 110 in the same direction as the direction in which the user's body is traveling.

As revealed in FIG. 4, the user will find it necessary to grasp the previously-mentioned handles 27 and 28 during this phase of the use of my device, with the user being readily able to bring about a desirable amount of motion of the elongate frame 10 along a horizontally disposed supporting surface as will cause the rollers of the frame to provide a comfortable, highly desirable amount of back massage.

It is to be realized that on some occasions, such as when utilizing the comparatively large roller 30 or 30*a* on the neck muscles, the weight of one's head causes undesirable strain on the neck muscles, particularly when the head is overhanging the large roller for a substantial extent. For this reason, I provide in accordance with one embodiment of my invention, a sturdy, relatively wide, tightly stretched elastic band 36 for supporting the weight of the head in such circumstance. The wide elastic band 36 is visible in FIGS. 1 and 8, and this feature will be discussed at some length hereinafter in conjunction with FIGS. 17 through 21.

Turning now to the embodiment of my invention associated with FIG. 5 and related figures, it will be seen that I may provide a preferred arrangement for supporting leg-contacting roller members of the general type shown at 108 and 110 in FIGS. 1 and 4. In FIG. 5 I show a relatively large framework 140, such as may be made of PVC components, although I am, quite obviously, not to be limited to such construction. A plurality of vertically disposed support members 142 are disposed along the near side of the frame 140 as depicted in FIG. 5, whereas a plurality of vertically disposed support members 144 are disposed along the far side of the frame as viewed in this figure, with the top portions and the bottom portions of these vertically disposed support members being connected by the use of respective horizontally disposed members in the manner shown in FIG. 5 so as to define a framework having a considerable amount of rigidity.

More particularly, horizontally disposed members 146 may extend along the lower portions of the vertically disposed support members 142, and be firmly attached thereto, whereas horizontally disposed members 156 may extend along, and be secured to, the lower portions of the vertically disposed support members 144.

Horizontally disposed member 148 may extend along the upper portions of the vertically disposed support members 142, and be firmly attached thereto, whereas horizontally disposed member 158 may extend along the upper portions of the vertically disposed support members 144 and be secured thereto, as shown in FIG. 5. As is obvious, all of these members may be joined together by suitable interconnection components held together by PVC cement and/or small screws, but as previously mentioned, I am not to be limited to this construction. For example, metal tubing could also be used.

One purpose for the provision of the relatively large frame 140 is to form a support for a rectangularly-shaped member hereinafter referred to as a common support member or slant board 60, upon which my novel elongate frame 10 may roll in certain instances, in the manner shown in FIGS. 6 and 7.

Figure 6:
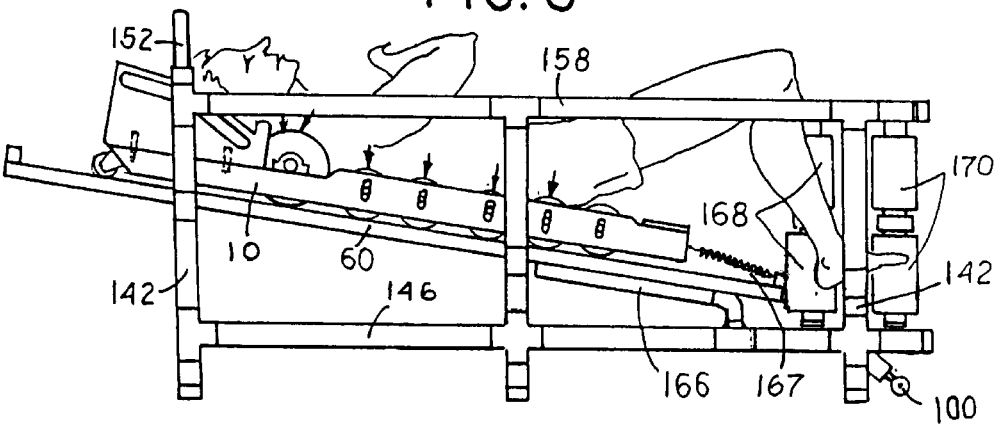
FIG. 6 is a side elevational view closely relatable to FIG. 5 and showing a user lying on the device and using his legs to move the frame, with it to be noted that the leg-contacting roller devices are disposed in their inactive positions adjacent one end of the frame.
Figure 7:
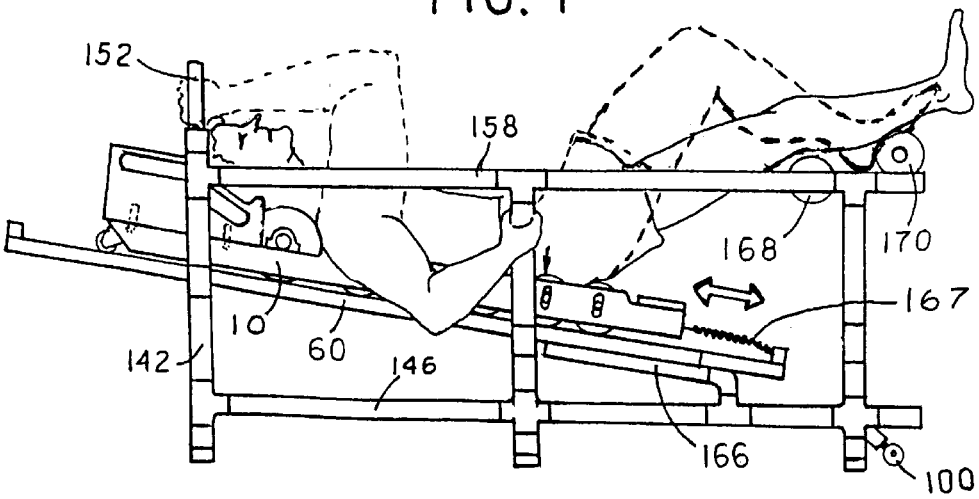
FIG. 7 is a view of the framework of FIGS. 5 and 6 upon the slant board of which my novel roller frame may be utilized, with the leg-contacting roller devices disposed in their active positions, and with this view making clear that either the arms or the legs of the user may be utilized for causing the elongate frame to move longitudinally with respect to the slant board carried by the lightweight frame.

As shown in FIGS. 6 and 7, I may optionally utilize a spring means 167 attached between the elongate frame 10 and the elongate support member 60, this spring means serving to bias the elongate frame in a direction away from its head end.

FIG. 8 clearly shows how my novel frame 10 may be utilized in conjunction with a rectangularly-shaped supporting member 72, upon which no leg supporting device is provided. Guide means consisting of tracks or slots 78 of the previously described type may be provided at the head end of the support member 72 in which the support wheels 17 may move back and forth, and tracks or slots 79 may be provided near the opposite end of the supporting member 72, in which the support wheels 19 may move back and forth. It is to be noted that FIG. 9 reveals the specific arrangement of the spaced-apart support wheels 17 operable in the pair of tracks or slots 78. By the interaction of the relatively small wheels with their respective tracks or slots, the frame 10 may be caused to maintain a desired alignment with the supporting member 72, which I may also refer to as the common support member.

Returning to FIG. 5, it will be seen that guide means consisting of tracks or slots 78 may be provided at the head end of the support member 60, which are spaced to receive the support wheels 17 of the elongate frame 10, in which tracks or slots the wheels 17 may move back and forth. Tracks or slots 79 are provided near the opposite end of the supporting member 60, which are spaced to receive the support wheels 19, such that the wheels 19 may move back and forth with movements of the elongate frame 10.

For supporting the left or upper end of the slant board 60 I provide, as shown in FIG. 5, an upper horizontally disposed support member 160 extending between and supported by the vertically disposed support members 142 and 144, as depicted at the left hand edge of FIG. 5. The mid portion of the slant board 60 is supported by the middle horizontally disposed support member 162. FIG. 5 reveals that the lower or right hand end of the slant board 60 is supported by the lower horizontally disposed support member 164, which extends between horizontal members 146 and 156. Additional rigidity may be secured by providing an angularly mounted member 166 that extends, as shown in FIGS. 6 and 7, from a mid portion of support member 162 to the mid portion of support member 164, with the lower surface of slant board 60 being in contact with the angularly disposed member 166.

Inasmuch as an important aspect of my invention involves the provision of leg supporting rollers, I have shown near the rear right hand edge of FIG. 5, two sets of roller members, these being the leg-contacting roller devices 168, rotatably mounted on a support 169, and a second pair of leg-contacting roller devices 170, which are rotatably mounted on support 171.

To permit easy access to the slant board 60, I preferably mount the sets of roller members 168 and 170 in such a manner that when not in use, these roller sets can be moved to one side, as revealed in FIG. 5, where they may reside in substantially vertical positions. Then, after the user has entered the frame 140, he or she can move the leg-contacting roller devices 168 and 170 into the active positions revealed in FIG. 7, wherein the roller members are horizontally disposed.

With continuing reference to FIG. 5, it is to be noted that a generally hook-shaped member 174 is provided at the bottom of the support member 169 forming the support for leg-contacting roller devices 168. Similarly, a hook-shaped member 176 is formed at the bottom of support member 171 from which the leg-contacting roller devices 170 are supported. At such time as the user has entered the frame 140, he or she can lift the roller device 170 and swing it into the generally horizontal position so as to cause hook-shaped member 176 to engage the upper horizontally disposed member 148 at a location near the right hand vertically disposed support member 142. The user then can lift the roller device 168 and swing it into the generally horizontal position revealed in FIG. 7*a* so as to cause hook-shaped member 174 to engage the upper horizontally disposed member 148 at a location that is also near the right hand vertically disposed support member 142. This, of course, causes the leg-contacting roller devices 168 and 170 to be disposed in the highly desirable positions shown in FIG. 7.

It will be seen that the upward inclination of the user's legs as depicted in FIG. 7 will bring about a particularly effective relationship of the user's back with respect to the upper surface of the comparatively wide generally cylindrically-shaped rollers 20 of the elongate frame 10.

This elevated leg position promotes total relaxation and reduces physical stress by tilting the pelvis upward, which elongates the spaces between the user's vertebrae, thus reducing pressure on the spine and relieving muscle tension and accompanying pain. The elevation of the legs also increases the circulation by helping pump blood back to the heart.

In addition, the pelvic tilt position flattens the lumbar region of the user's spine and thus facilitates the massage of the lower back area by the gentle movement of the padded rollers as they help stretch the lower spine muscles, alleviating spasms and soothing sore muscles.

At the left hand edge of FIG. 5 I reveal that I may utilize a pair of horizontally disposed handles 150 and a pair of vertically disposed handles 152 on the frame 140, which the user may utilize in the general manner indicated in FIG. 7.

It is thus to be seen that the user, by the use of his or her arms, can cause his or her body to move back and forth on the body-supporting rollers 20 to bring about effective massage. There are instances in which the user's feet can be resting against one of the leg-contacting rollers, such as the roller 170 as shown in FIG. 7. It is to be understood that the user can bring about a desired massaging action of the rollers 20 on his or her body by pushing against the leg-contacting roller, or as an alternative to this, the desired massaging action of the rollers can be brought about with the calves of the legs resting on the rollers 168 and 170, with motion of the frame 10 brought about by the user's arms.

It will be noted from FIGS. 5 through 7 that I may employ a pair of casters or small wheels 100 on the lower right hand portion of the framework 140, thus to enable the user to readily move the framework to an out-of-use location when the utilization of the equipment has been completed for the day.

With specific reference to FIG. 8, it is important to note that the mid portions of the generally cylindrically-shaped rollers are preferably of reduced diameter. As a result of my utilization of a spaced array of body-contacting rollers having mid portions of reduced diameter, the roller surface on each side of the reduced diameter mid portion of each roller is in firm contact with the muscles of the user's back, with the several rollers serving to perform a comfortable yet highly effective massaging action on such back muscles. As is obvious, this arrangement utilizing rollers having reduced diameter, necked-down mid portions avoids undesired contact of the rollers with the vertebrae associated with the spinal column of the user when the user is lying in a supine manner on the rollers. The mid portion of the large roller 30 and the mid portion of the roller 30*a* are each of reduced diameter also.

With continuing reference to FIG. 8, it will be seen that I have shown an embodiment of my massage and exercise device closely resembling the embodiment shown in FIG. 1, but here used upon a flat common support member 72. It has already been made quite clear that the spacing of the parallel tracks or grooves 78 is such as to receive the support wheels or casters 17 located at the head of the elongate frame 10, and the spacing of the tracks or grooves 79 is such as to receive the support wheels or casters 19 that are mounted upon the flat end member 18 of the frame member.

The utilization of properly spaced tracks or grooves on the flat support member 72 is mandatory, because this arrangement assures the frame 10 remaining in a proper location on the flat support member 72 at all times during use.

In FIGS. 10*a* through 10*c*, I reveal different roller shapes, characteristics and sizes that may be used in accordance with this invention. It will be noted that in each instance, the mid portions of the rollers are of diminished diameters so as to avoid undesirable contact with the spinal column of the user, and it is to be understood that all of these rollers have essentially the same axial length. An end cap with a small center hole through which a steel axle 113 will extend is inserted into each end of each roller, and on each end of each roller the axle will be attached to a respective spindle. Since the steel axle is appropriately configured on each end, it will tightly fit into each of the spindles.

FIG. 10*a* depicts the largest roller I utilize in connection with my massage and exercise device, with this roller preferably being utilized to massage the head, neck and shoulder areas of the user. The roller is essentially of cylindrical configuration with a foam covering shaped to comfortably receive the back of the user's head and neck and to massage the shoulder area, and I typically configure the relatively hard inner core of each of the rollers to have an inner diameter of appropriate size. The desired effective outer diameter of each roller may be achieved either by using foam coverings on each side of the roller, leaving the center diameter of the roller without a covering, as in FIG. 10*b*, or by using a continuous foam sleeve covering over a roller that has a reduced central diameter, as in FIG. 10*c*. The surface member surrounding the core portion of each roller can range from being soft to being comparatively hard or tough, for it is desirable for the weight of the user's body not to cause the spinal column to press tightly against each roller of the array. Additional roller construction will shortly be discussed in greater detail.

FIG. 10*b* is a longitudinal view of an exemplary type of roller also essentially of cylindrical configuration, with a foam covering on each side of the mid portion of the roller, which roller may be utilized in the frame of my novel back massage and exercise device. The core material of the roller of FIG. 10*b* is hard and unyielding, whereas the foam covering is compressible to some degree.

FIG. 10*c* is a longitudinal view of another roller, which is quite different from the roller depicted in FIG. 10*b*. The roller of FIG. 10*c* is tapered toward the center mid portion of the roller, but there is a convex protrusion on both sides of the mid portion, for the purpose of massaging the muscles on either side of the spinal column. The roller of FIG. 10*c* works particularly well on the middle and upper back.

FIG. 11*a* is a perspective view of a novel roller in accordance with this invention in which an elastic band contains a row of uniformly-shaped protrusions 138 and stretched along each side of the recessed mid portion of the roller, are protrusions serving to stimulate trigger points located along each side of the user's spine.

In FIG. 11*b* I show a perspective view of the roller depicted in FIG. 10*b* with the steel axle 113 extending through the roller and the end caps into the spindles on each side of the roller.

In FIG. 11*c* I have shown the cross sectional configuration of yet another style of roller of the type that may be utilized on my device. This particular type of roller utilizes a plurality of individual prongs or fingers 139 about its periphery, intended to provide substantial stimulation to the skin of the user. I prefer the covering of this roller to be of latex material.

I have found that many different foam coverings work well with the rollers. I prefer an acrylonitrile PVC with a 7–8 lb. density for the roller depicted in FIGS. 10*a* and 10*b*. Armaflex II roll insulation works well for rollers depicted in FIG. 10*c*. It is a closed cell structure, thus retarding the flow of moisture vapor.

With regard to the core portion of the rollers I utilize, I prefer the roller construction to be of hollow PVC, but I wish to make clear that in constructing these rollers, I am not to be limited to this material. The firm cores of the rollers may be solid or hollow and may be constructed of metal, wood, plastic or other similar materials. The body-contacting portions are typically compressible to some degree.

Figure 12A:
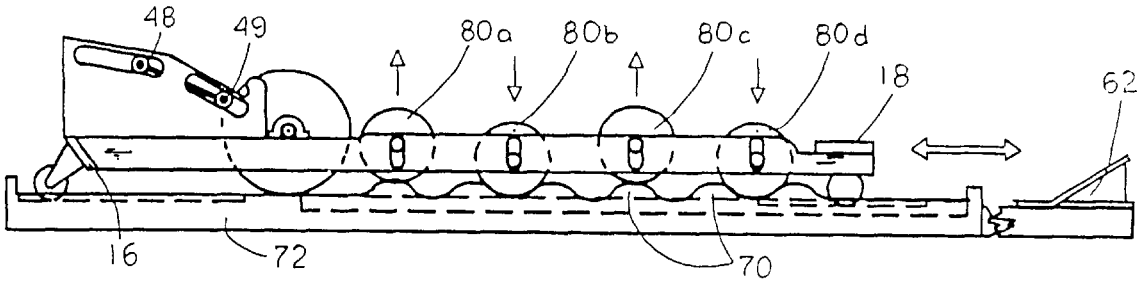
FIG. 12*a* is a side elevational view of an embodiment of my back massage and exercise device used in conjunction with a supporting surface having side edges of an undulating, wave-like configuration, with these undulating side edges causing the rollers to move up and down as the roller frame moves longitudinally along the supporting surface.

With reference now to FIG. 12*a*, it will be noted that I have revealed a side view of an embodiment of my back massage and exercise device that is being utilized in conjunction with a supporting surface 70 having comparatively narrow undulations, with the supporting surface resting upon a common support member 72. It will be further noted that the peaks and valleys of the undulating surface 70 are spaced in a relationship similar to the spacing of the rollers of the frame. The spacing of the supporting surface 70 and the unseen identical supporting surface located on the other side of the device is such that these members will effectively support the rollers utilized in my novel elongate frame 10. As will be discussed hereinafter, the undulating or generally sine wave shaped support surface 70 and the unseen support surface utilized therewith may be employed either in an out-of-phase relationship, or in an in-phase relationship.

With continued reference to FIG. 12*a*, it is to be noted that the supporting surface 70 represents a relationship in which the roller 80*a* rests on what may be regarded as a first peak of the supporting surface 70, whereas the adjacent roller 80*b* rests not in the next valley, but in the second valley away. Similarly, the roller 80*c* rests not on the next peak, but on the second peak away from roller 80*b*, and the roller 80*d* rests in the second valley away from the peak upon which roller 80*c* rests. The use of the spaced pair of supporting surfaces 70 of comparatively narrow undulations provides a highly desirable motion to the rollers, and to the body of the user supported thereon.

Figure 12B:
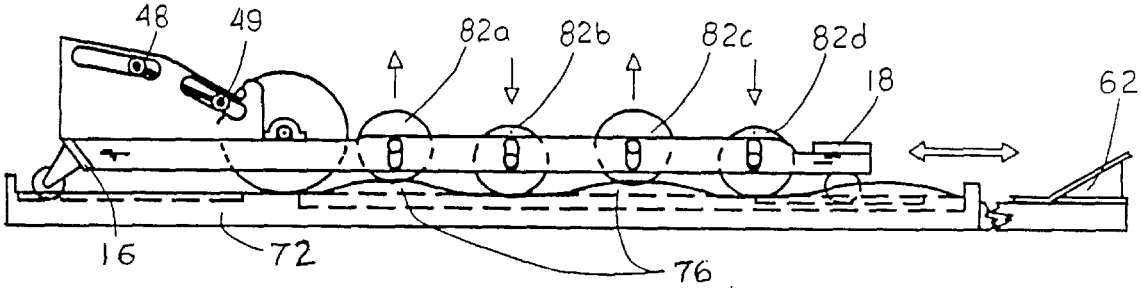
FIG. 12*b* is a view similar to FIG. 12*a*, but here showing a support member whose wave-like side members have a more gradual configuration, being less sharply defined.

In contrast, FIG. 12*b* involves an embodiment of my back massage and exercise device that is being utilized upon a supporting surface 76 having a somewhat different undulating configuration, in that the peaks of this undulating surface are spaced relatively far apart. As a consequence of this arrangement, whereas the roller 82*a* rests on a peak, the adjacent roller 82*b* rests in the next valley. Similarly, the roller 82*c* rests on the next peak, and the roller 82*d* rests in the next valley away from the peak upon which roller 82*c* rests. Although not shown, it is to be understood that undulating or generally sine wave shaped supporting surface 76 is utilized in conjunction with an appropriately configured matching member mounted on the far side of the common support member 72.

Figure 13:
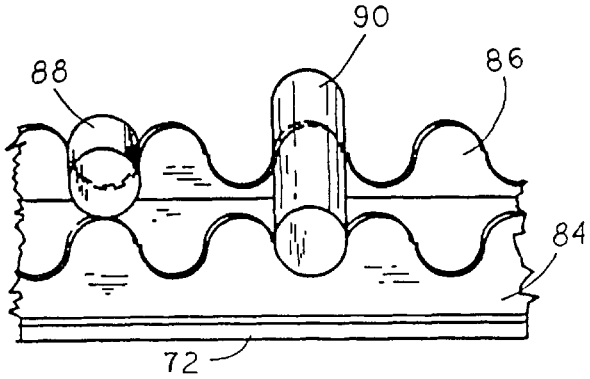
FIG. 13 is a fragmentary perspective view revealing to a large scale how the wave-like supporting members on one side of the flat support member may be out of phase with the wave-like supporting members on the other side of the common support member, thus to cause one end of each roller to be undertaking a motion different than the motion of the other end of the roller.

In FIG. 13 I illustrate a relationship of undulating support members 84 and 86 in which these members are mounted on a common support member 72 and disposed in an out-of-phase relationship. From this figure it will be seen that the far side of the roller 88 depicted on the left side of FIG. 13 is resting in a valley of the remotely located undulating support member 86, whereas the near side of roller 88 is resting on a peak of the undulating support member 84 located in the foreground.

Continuing with FIG. 13, it will be seen that the far side of the roller 90 is resting on a peak of the remotely located undulating support member 86, whereas the near side of roller 90 is resting in a valley of the undulating support member 84 located in the foreground. From this illustrative example it can be seen that the rollers of the frame member move in an opposite manner when the undulating support members are utilized in an out-of-phase relationship.

Figure 14A:
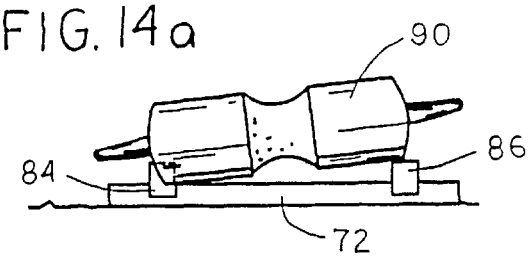
FIG. 14*a* reveals how one end of a given roller of the device depicted in FIG. 13 moves upwardly with respect to the other end when the wave-like side edges of the supporting surface are mounted in an out-of-phase relationship.
Figure 14B:
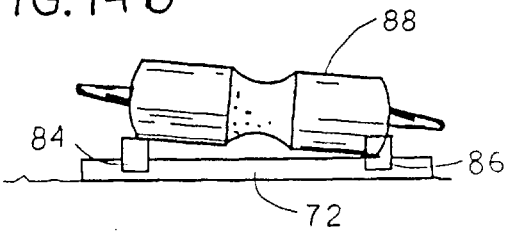
FIG. 14*b* is a view similar to FIG. 14*a*, but here showing the other roller of FIG. 13, wherein an opposite roller movement has taken place.

With reference now to related FIGS. 14*a* and 14*b*, it is to be seen that I reveal in cross section, the appearance of a typical supporting surface in accordance with this invention, that may be utilized below the roller frame in order that the rollers can be caused to undertake out-of-phase movements. It is to be understood with regard to the positioning of FIG. 14*a* that it represents the position of roller 90 of FIG. 13, whereas FIG. 14*b* represents the position of roller 88 of FIG. 13. In FIGS. 14*a* and 14*b* I reveal that the rollers 88 and 90 preferably have mid portions that are necked down, or in other words, have somewhat reduced diameters. I typically mount the undulating members 84 and 86 to the base member or common support member 72 in a removable manner. This of course makes it readily possible for the user to dispose the undulating support surfaces either in an in-phase or an out-of-phase relationship.

As will now be readily understood, if the members of undulating configuration are utilized in an aligned, parallel relationship, the rollers can be expected to undertake an up and down motion as the frame moves along the special supporting surface, and in such instance, the rollers will maintain a substantially parallel relationship at all times.

In contrast with this, if the members of undulating configuration are utilized in an out-of-phase relationship, the rollers can be expected to undertake a side-to-side tilting motion of the type shown in FIGS. 14*a* and 14*b*, as the roller frame is caused to move along the special supporting surface. When one roller is in the position shown in FIG. 14*a*, the adjacent roller located in the frame 10 may be in the position shown in FIG. 14*b*.

Figure 15:
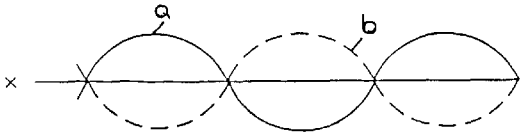
FIG. 15 is a view utilizing sine waves to represent the configuration of the opposite sides of the supporting surfaces of undulating configuration.

FIG. 15 reveals by the use of a solid line a, a sine wave representing the shape of a typical member of undulating configuration, with the dashed line b, also of sine wave configuration, being utilized to illustrate that the other member of undulating configuration may be used in an out-of-phase relationship with the first member.

Figure 16:
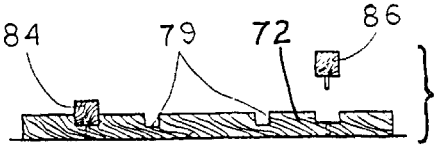
FIG. 16 is an end view, revealing how the side edges of undulating configuration may be affixed to the support member.
Figure 17:
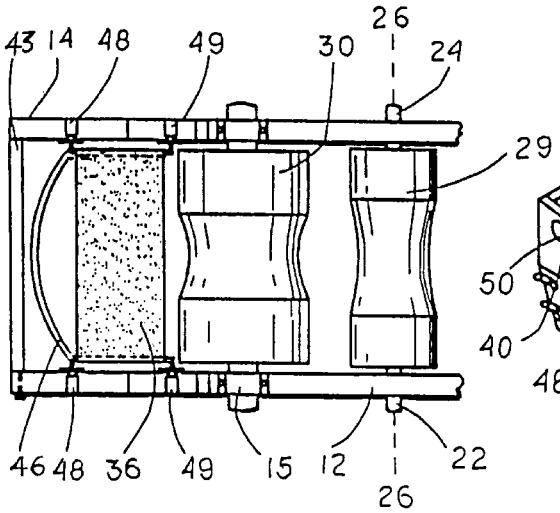
FIG. 17 is a plan view of a fragmentary portion of the head end of my elongate frame, revealing the use of a movable carrier arrangement operatively disposed adjacent the large roller of the frame, with this carrier arrangement serving to support the user's head during certain phases of frame motion.

With reference to FIG. 16, which represents a cross-sectional view of the foot end of the flat common support member 72, it is to be noted that in this figure I have shown the undulating support member 86 slightly removed from contact with the member 72, with this being done to illustrate the fact that at the behest of the user, the one undulating support member may be placed in an in-phase relationship or in an out-of-phase relationship to the other undulating support member. To this end I may utilize a plurality of downwardly extending pegs or dowels in either or both of the undulating support members, with a series of holes provided adjacent one or both of the long edges of the member 72 for receiving such pegs or dowels. Such series of holes may reside in grooves of a width to receive support members 84 and 86. By an appropriate utilization of peg and hole placement, the user can insert an undulating support member in the desired relationship to the other undulating support member.

It is also to be noted in FIG. 16 that I have shown a spaced pair of tracks or grooves 79, with the spacing of these tracks or grooves corresponding to the spacing of the support wheels 19 utilized on end member 18 of the frame 10, as previously discussed. The tracks or grooves 79 are disposed in a parallel relationship to the tracks or grooves 78 provided as the guidance means for the wheels or casters 17, as will be seen from an inspection of FIG. 24. As a result of traveling in these tracks or grooves, the elongate frame 10 of my novel back massage and exercise device can be effectively operated in a desired location, and with an effective relationship being maintained between the ends of the elongate rollers and the undulating support surfaces. As is obvious, if the frame 10 were allowed to move to one side or the other of the flat support member 72, the ideal relationship of the end portions of the elongate rollers to the respective undulating supporting surfaces would not be able to be maintained.

It will be recalled that the vertically elongate slots 32 and 34 in the side members 12 and 14 are of sufficient height as to permit the up and down excursions of the axle members 22 and 24 to take place substantially without restraint as a result of the contact of the end portions of the rollers with the aforementioned undulating support members. It should now be quite clear that guidance for the support wheels 17 is provided by the parallel tracks or grooves 78, and guidance for the support wheels 19 is provided by the parallel tracks or grooves 79 while the up and down roller motions are occurring.

With reference now to FIGS. 17 through 21, it is to be understood that the large elastic head-supporting band 36 is supported on a movable carrier member 46, that may be regarded as generally of U-shaped configuration. The large, head-supporting elastic band 36 is mounted in a tightly stretched condition in the movable carrier member 46, with the arrangement being such that the band 36 is longitudinally placed so as to reside between the end member at the head of the frame 10 and the large roller 30.

The movable carrier member 46 is mounted in a head frame 40 that is in turn mounted in a stationary manner upon the elongate side members 12 and 14 of the frame 10. The head frame 40, typically made of the same material as that from which the frame 10 is made, may be regarded as a three-sided device held in a selected location on the head end of the frame 10.

A series of vertically disposed holes located in the underside of the head frame 40 are spaced so as to permit the head frame to be placed upon pegs or pins of the elongate frame 10 in a desired relationship. Because of this feature, the user may place the head frame 40 in a selected location on the frame 10.

Figure 20:
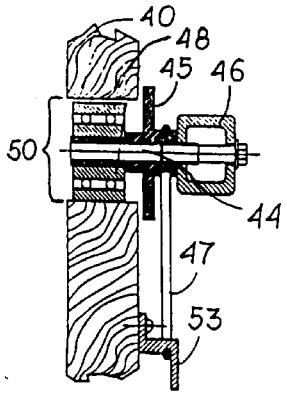
FIG. 20 is a cross sectional view to a relatively large scale, revealing the use of the bias means utilized for assuring the return of the head supporting carrier member to a location close to the large roller positioned under the neck and shoulder area of the user.

Because there may well be a relatively large amount of tension associated with the head supporting band 36, it is desirable for the movable carrier member 46 to possess a certain amount of strength, so I prefer to construct the member 46 of tubular steel. In FIG. 20 I reveal that this tubular steel member may have a generally rectangularly shaped cross section.

Figure 18:
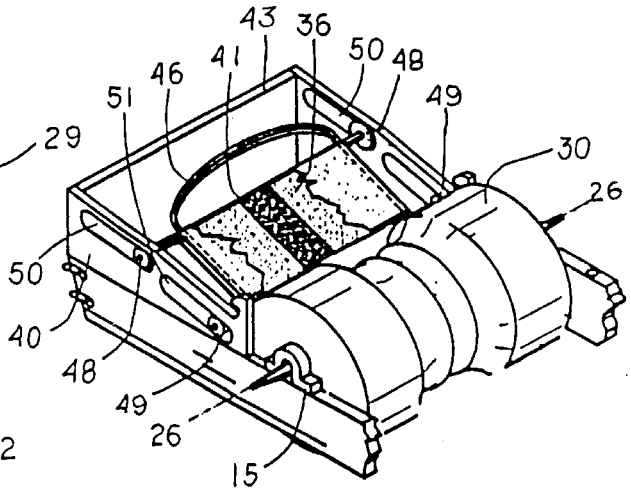
FIG. 18 is a fragmentary perspective view to a somewhat larger scale than FIG. 17 and revealing slots in the head frame along which the movable carrier member of FIG. 17 can move in the head frame as a consequence of the user changing his or her longitudinal position while lying upon the rollers of the frame.

As best seen in FIG. 18, adjacent the curved, uppermost portion of the member 46 is a mounting arrangement for a first pair of rollers 48, which are positioned to reside in respective slots 50 located in the head frame 40. The sides of the tubular steel member 46 also continue along in a parallel relation to the sides of the head frame 40, so as to form the support for a second set of rollers 49. The rollers 49 reside in respective slots 51, as best seen in FIG. 18.

Figure 19A:
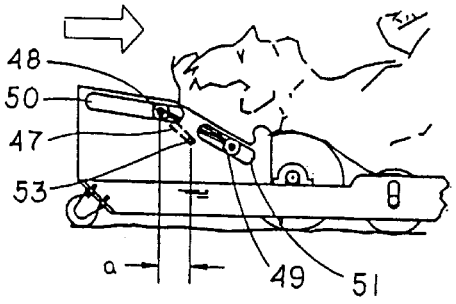
FIG. 19*a* is a somewhat simplified fragmentary view further revealing the use of the relatively small elastic band serving as the bias means for normally biasing the movable carrier and its tightly stretched, head-supporting elastic band into a position relatively close to the large roller.
Figure 19B:
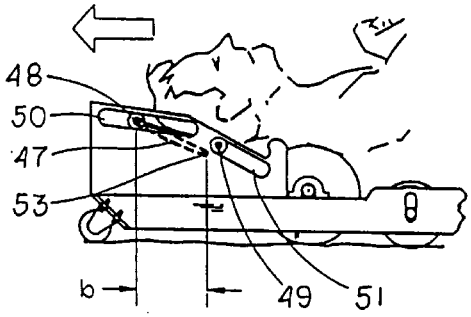
FIG. 19*b* is a fragmentary view closely related to FIG. 19*a*, but in this instance showing that the elastic bias band has stretched to accommodate the movable carrier member having moved away from the large roller and toward the head end of the frame as a result of the user changing his or her longitudinal position on the elongate frame.

The pair of elongate slots 50, located on opposite sides of the head frame 40 relatively near the head frame brace 43, are to be seen as inclining slightly downwardly in the general direction of the end member 18 of the frame 10, whereas the elongate slots 51, also located on opposite sides of the head frame 40, are to be seen as being inclined more steeply downwardly, generally in the direction of the axial mounting for the large roller 30; note such detail in FIGS. 3, 4 and 18 as well as in FIGS. 19*a* and 19*b*. As is obvious, the downwardly angularity of the pairs of slots 50 and 51 results in the carrier member 46 being gravity biased toward the large roller 30.

It is thus to be seen that as the user's head engages the head supporting band 36 and causes the motion of same, the pairs of rollers 48 move in their slots 50, and the pair of rollers 49 move in their slots 51, with this arrangement serving to provide a stable yet freely movable device permitting longitudinal movements of the user's head as the elongate frame 10 moves along the supporting surface. The sturdy, head-supporting elastic band 36 and its movable carrier member 46 are thus to be seen as continuously supporting the head of the user in a highly effective manner as the user's head moves further and further away from the large roller 30 during head and neck massage.

With reference to FIGS. 19*a*, 19*b* and 20, it is to be seen that I may utilize a bias member in the form of an elastic band 47 for supplementing the tendency of the carrier member 46 to return to a location adjacent the large roller 30 under the influence of gravity. In FIG. 19*a*, the elastic band 47 will be seen to be in a relatively unstretched condition when the head supporting elastic band 36 is relatively near the large roller 30, whereas in FIG. 19*b*, the band 47 has been stretched as a result of the user's head moving so as to cause the movable carrier member 46 to move toward the head end of the device.

As should now be clear, because of the placement and configuration of the slots 50 and 51, as the movement of the user's head causes the head-supporting band 36 and its carrier 46 to move in the direction away from the large roller 30, the large elastic band 36 moves from a rather steeply inclined attitude into a more nearly flat attitude, this taking place as a consequence of the rollers 49 moving upwardly in their respective angularly placed slots 51. Because of this highly advantageous head-supporting arrangement, the user may undertake effective head, neck and shoulder massage in conjunction with the large roller 30 without the threat of strained or overextended neck muscles.

In FIG. 20 I reveal the cross sectional appearance of the arrangement I prefer to utilize for the support of a typical roller 48 by the tubing out of which the movable carrier member 46 is created. In the preferred instance, I utilize a comparatively long bolt 44 that is closely fitted in a suitable hole in the member 46, with this bolt serving as the axle upon which the roller 48 is rotatably mounted. So as to maintain a proper relationship between the carrier member 46 and the head frame 40, I prefer to utilize a spacer 45, such as of plastic.

Made clear in FIG. 20 is the use of an elastic band 47 that serves to bias the carrier member 46 in the direction of the large roller 30. I prefer to utilize an elastic band 47 on each side of the head frame, with a suitable hook 53 utilized on each side of the head frame, as the attachment point for each elastic band.

Figure 21:
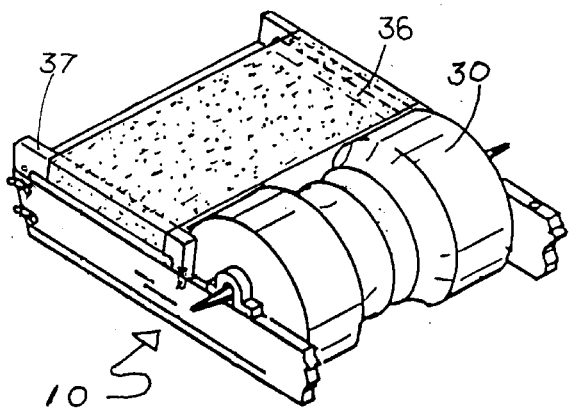
FIG. 21 is a fragmentary perspective view generally relatable to FIG. 18 and revealing an alternative embodiment of a head frame utilized in conjunction with the large roller, which head frame, though fixed, effectively serves to prevent the head of the user from tilting too far rearwardly.

FIG. 21 reveals a perspective view of a simplified head rest which merely prevents the user's head from arching back. It consists of a wide elastic band 36 similar to the one used in FIGS. 17 and 18. The band is stretched across the head frame 37 in a tight position. If the user desires a higher elevation he or she may place a small pillow above the band. The head frame 37 is preferably held in the desired position adjacent the head end of the elongate frame 10 by the use of suitable pins that extend into appropriately sized holes drilled into the frame.

With regard to FIG. 22, it has previously been mentioned that I prefer to mount the relatively small support wheels 17 on the end member 16 that is disposed at approximately a 450 to the plane of the frame member 10. This angular mounting of the support wheels 17 makes it conveniently possible for the user to lift the end of the frame member 10 opposite the head, and then to move the frame member from one location to another in the manner that a laborer would move a wheelbarrow from one location to another. In this way, the user does not have to lift the entire weight of the frame member and the rollers carried therein.

Turning now to FIG. 23, this is a fragmentary perspective view to a large scale, with portions broken away to reveal internal construction of a pushbutton spring device, which type of device may be used at various sections or locations of a supporting framework in order to permit certain members of the framework to pivot or extend. The components shown in FIG. 23 illustrate some of the components that may be utilized in the arrangement depicted in FIG. 24, wherein a support member 74 is supported in a position in which it can receive thereon, one of my novel roller frames utilized in various multimode relationships. The support member 74 is disposed in an angular manner, in what may be regarded as a slant board relationship.

Continuing with FIG. 23, pins or pushbuttons 95 are slidably mounted in a spring biased manner in a structural member 127 of rectangular cross-section, with these pins or pushbuttons being biased outwardly by compression springs 97, that are slidably mounted on guide members 94. Suitable shoulders are provided on the inner portions of the pushbuttons 95, to prevent them from being pushed out of contact with the holes in which they are mounted.

Because member 127 is slightly smaller in cross section than the member 120, the member 127 may extend into the member 120 for a selected extent, in what may be regarded as a telescopic relationship therewith. The set of pushbuttons mounted in the member 127 are sized so as to be readily received into a selected pair of the holes 93 located in the structural member 120. As will be obvious to those skilled in this art, when the structural member 120 and the structural member 127 have been interfitted to a desired extent, the pushbuttons 95 can be caused to enter a particular pair of holes 93 in the member 120, thus securing the members 120 and 127 together. By selecting the particular pair of holes 93, the user can establish the effective length of the structural arrangement. By providing a number of aligned pairs of holes 93 along the sides of the member 120, the user can carefully adjust the longitudinal relationship between the members 120 and 127.

Returning to a consideration of FIG. 24, the arrangement involves the lower end of the support member 74 being supported by a structural member 125 that is in turn supported by a base member 126, whereas the upper end of the support member 74 is supported by a member 120*a* connected in a telescopic relationship to a slightly smaller member 127*a* that is in turn connected to a base member 126*a*.

Mounted securely upon a central portion of the base member 126 are a pair of substantially identical curved members 128, best seen in FIG. 24*a*, which members are spaced apart to a sufficient extent as will permit a structural member 120 of rectangular cross-section to be rotatably mounted therebetween. More particularly, the lower end of the structural member 120 is pivotally attached to a lower central portion of each of the curved members 128, with this pivotal attachment made possible by the use of a pin 96 extending through both members 128 as well as through the lowest portion of the rotatably mounted structural member 120.

Arrayed around the curved upper edges of the curved members 128 are a spaced series of holes 133, with the holes of one member 128 being in careful alignment with the other member 128. Mounted inside a lower portion of the member 120 are a pair of small, round members 95 of a diameter such that they can readily protrude through one of the aligned pairs of holes 133. The members 95 are in the nature of pushbuttons, being biased outwardly by a suitable spring arrangement. Although the details of the pushbuttons 95 are not shown in detail in FIG. 24*a*, they are to be understood to resemble the construction relating to spring biased pushbuttons described in conjunction with FIG. 23.

As will be seen from FIG. 24, and in somewhat clearer detail in FIG. 24*a*, the rotatably mounted member 120 is able to be moved into a selected angularity with respect to the support member 74 and with respect to the base member 126 at such time as both of the pushbutton-like members 95 have been pushed inwardly against their spring bias, and then released when these pushbutton members are in alignment with a desired pair of the aligned holes 133. This arrangement makes it readily possible for the user to select the angularity of the member 120, and of the components inserted into member 120.

Adjustability of the position of the leg elevation device or leg elevating device 130 in FIG. 24 is thus made possible by the use of the rotatably mounted member 120, and the telescopic arrangement involving the relationship of member 120 with member 127. The angularity of the leg elevation device 130 depicted in FIG. 24 is thus determined by a use of the relationships utilizing the pushbuttons 95 described in connection with FIG. 24*a*, whereas length is determined by the selection of the holes 93 into which the pushbuttons 95 are permitted to extend.

Also apparent from FIG. 24 are a pair of curved, firmly mounted, non-pivoting handles 122 and 124 that extend upwardly from the base member 120*a*, with the handles being spaced widely enough apart as to clear the side edges of the support member 74, but yet located closely enough together as to permit the user to grasp one handle in each hand. Because of the location and rigid mounting of the handles 122 and 124, the user can utilize his or her arms in causing the roller-mounted elongate frame 10 to move up and down along the angled support member 74. By the use of the previously mentioned pair of tracks or grooves 78 at the head end, and the pair of tracks or grooves 79 adjacent the foot support, the frame member 10 is kept from falling sideways off of the support member 74, by virtue of the utilization of guide means involving the engagement of the pairs of rollers or casters with their respective grooves or tracks.

The user is not forced to use only his or her arms for bringing about upward movement of the elongate frame 10 along the angularly disposed support member 74, for as previously mentioned, the leg elevation device 130 is supported from the base member 126, and the user can of course use his or her feet and hands simultaneously in order to bring about movement of the frame 10 along the elongate support member 74. Alternatively, the user can utilize just his or her hands or just his or her feet for bringing about the desired longitudinal movement of the elongate frame 10 along the elongate support member.

Also shown in FIG. 24 is another pair of handles, handles 132 and 134. With one end of these handles, the user is provided assistance in getting on and off my novel back massage and exercise device, and with the other vertical side of these handles the user can optionally push the elongate frame 10 back and forth.

Figure 25:
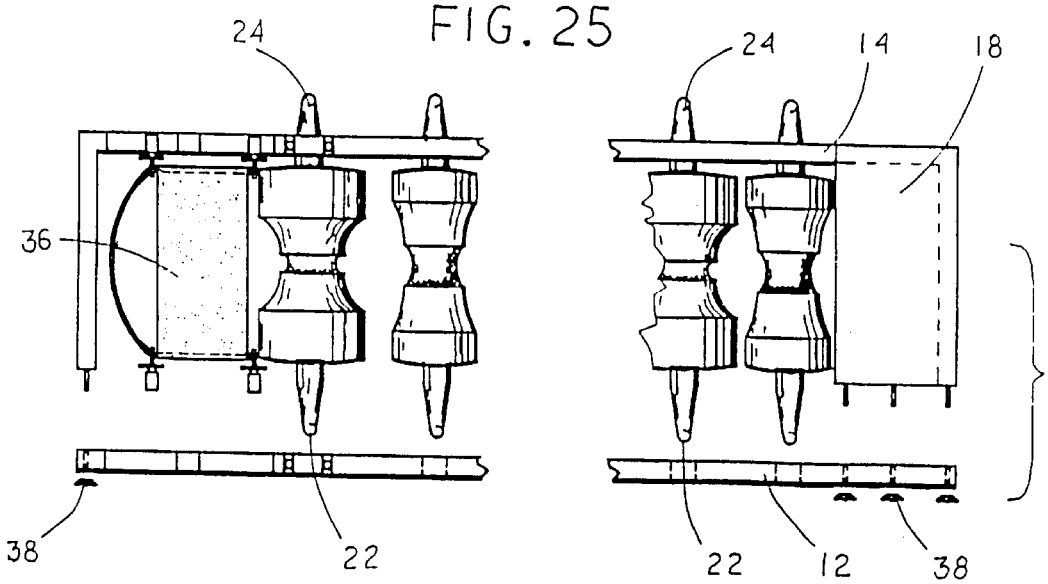
FIG. 25 is a plan view illustrating how one long side of the frame may be removed in order to permit one or more rollers to be exchanged for a roller of a different size, characteristic, or degree of hardness, with a mid portion of the long sides of the frame being broken away in the interests of clarity.

It is within the spirit and scope of this invention for the user to be able to select rollers of a desired contour and hardness or of a desired diameter, so as shown in FIG. 25, I reveal that elongate member 12 can be loosened to an extent making it possible for some or all of the rollers to be removed from the elongate frame 10, by first removing the axle members 22 from the slots 32, and then the axle members 24 from the slots 34. To this end, I preferably provide wing nuts 38 on the bolts holding the long side 12 to the end members 16 and 18, such that by loosening the wing nuts, the side 12 can be moved either partially or entirely away from the other members of the frame 10.

It thus should be obvious that when the axle member on one end of each roller is moved out of contact with the long side 12, it is readily possible for the user to remove some or all of the rollers from the frame, and to replace such rollers with rollers that are softer or harder or of a different diameter or contour.

Figure 26:
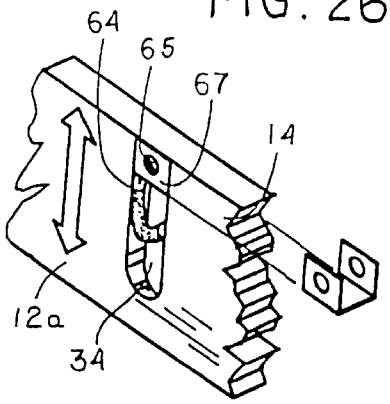
FIG. 26 is a fragmentary perspective view to a large scale, revealing a means for biasing the axle of a roller into the upper portion of its vertically elongate mounting slot, this arrangement involving the use of an elastic band.

Turning to FIG. 26, it will be seen that this is a fragmentary perspective view serving to reveal the optional use of an elastic band 64 for pulling upwardly on each roller axle. This elastic band is of course provided for the purpose of pulling the roller into contact with the user's body, when the user's weight is not on that specific roller. The elastic band 64 is mounted to the top of the slot by means of a clip 67 fastened to the top of the vertically elongate slot by screws 65 in the clip sides. The elastic band 64 is particularly useful with an undulating surface as well as a flat surface. For that reason I prefer, but I am not limited to, the arrangement depicted in FIG. 26 for use in all of the elongate slots of the side rails 12 and 14.

Figure 27:
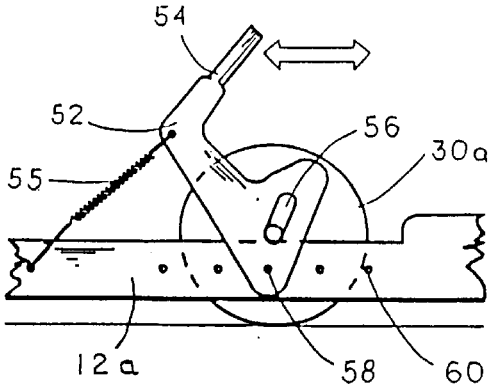
FIG. 27 is a fragmentary view revealing an alternative mounting for a large roller utilized adjacent the head end of my novel movable frame, with this embodiment of the large roller being able to be moved relative to the frame by the user manipulating a pair of handles together in alternate forward and aft directions in order to accomplish a highly effective head, neck and shoulder massage.
Figure 28:
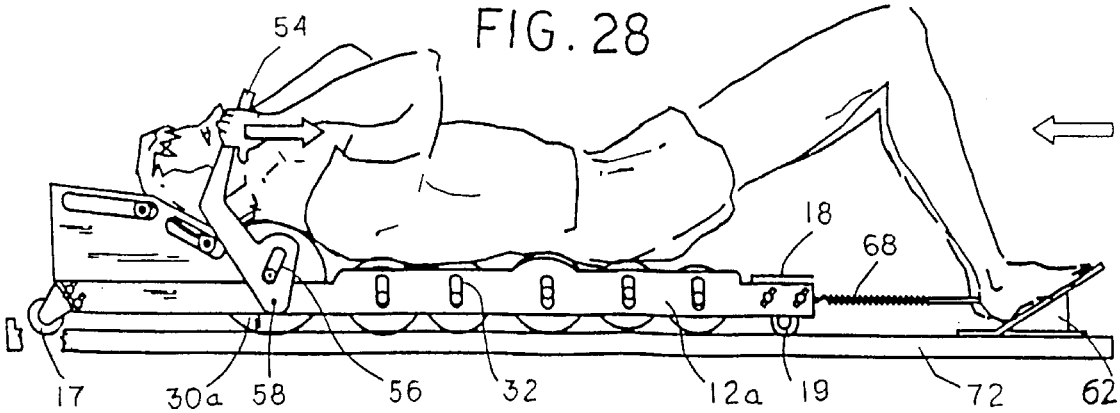
FIG. 28 is a view to a somewhat smaller scale than FIG. 27, with FIG. 28 revealing the user lying in a supine position on the upper surfaces of the rollers of the elongate roller frame, with it to be understood that the user can accomplish a type of head, neck and shoulder massage as a result of the fore and aft manipulation of the handles in a timed relationship to longitudinal movements of the user's body along the elongate frame.

It has previously been made clear that it is highly advantageous to utilize a large roller near the head end of my novel frame, and now with reference to FIGS. 27 and 28, it will be noted that I have shown a particularly important embodiment, involving an independently mounted arrangement for large diameter roller 30*a*, with this roller being of a distinctly larger diameter than the rollers 20. This highly desirable embodiment of my invention makes it possible for the user to accomplish a massage of his or her head, neck and shoulders during the movement of the elongate frame 10, by a counter motion which moves the head and neck roller 30*a* closer to the neighboring roller over a supporting surface.

More particularly, in the embodiment in accordance with FIGS. 27 and 28, I mount the axle located at each end of the large roller 30*a* in a respective portion of a pivotally mounted frame member 52. Attached to each side of the frame member is an upstanding handle 54. As will be noted, particularly in FIG. 27, the axle member of the roller 30*a* is located in a long slot 56 provided in the near side of the pivotal frame 52, with a like slot being provided in the opposite side of the frame 52, which is not visible in these figures.

Disposed below the long slot 56 of each side of the frame is a mounting hole 58, in which a pin is to be inserted in order to form a pivotal attachment of the frame 52 to the elongate side member 12*a*. By virtue of the provision of substantially identical frame members on the opposite side of the frame 10, the user, by the use of his or her two hands, is enabled to move the two sides of the frame members 52 in coordination, and thus cause the large roller 30*a* to move at least one inch with respect to the frame 10 and the rollers 20 utilized in the frame. During such movement of the handles, the large roller 30*a* is caused to undertake horizontal movement with respect to the member 12*a* as well as with regard to the supporting surface, and this roller movement may or may not be accompanied by movement of the frame 10 along the supporting surface.

Because the axle member of the large roller 30*a* rolls along a flat top surface of the elongate side member 12*a* (and the elongate side member 14*a*, not shown), the vertical height of the roller 30*a* is unaffected during its movements resulting from the user's manipulation of the pair of handles 54.

The user is clearly not required to employ the large roller 30*a* in any particular manner, although many hours of utilization of my novel device have indicated that the larger roller can be employed in a particularly effective manner by bringing such into contact with the muscles of the neck and shoulders. The independent mounting of the large roller 30*a*, and the placement of the handles 54 adjacent the opposite sides of the roller make it possible for the user, by coordinated movements of the handles 54, to massage his or her head, neck and shoulder region gently and quite effectively in the general manner shown in FIG. 28.

It is to be noted that in FIG. 28, the user is depicted lying on the rollers 20 in the typical manner, with the large roller 30*a* in contact with the user's neck and head, and with the user, by the use of his or her two hands, holding the pair of handles 54. Also to be noted is the fact that the long slot 56 is of sufficient length that the roller 30*a* can maintain a continuous contact with the supporting surface throughout the independent movements of the roller 30a with respect to the frame 10, which independent movements of the large roller are brought about by a coordinated manipulation of the handles 54. FIG. 28 further reveals that the user's feet may be in contact with a foot support 62.

An optional tension spring 68 may be attached to the foot end of the elongate frame 10 and to the foot rest 62. This spring creates resistance to the leg movement depicted in FIG. 28, thereby increasing the amount of exercise to the user of my novel device. The spring means 68 thus serves to bias the elongate frame in a direction away from its head end.

Regarding the timing of the user pulling the handles 54, I have found it particularly effective for the user to pull the handles in the direction of the arrow shown near the user's head in FIG. 28 at the same time that the frame 10*a* is moving in the longitudinal direction toward the head of the user, as indicated by the arrow located near the user's feet. This combined movement causes the user's shoulder and neck area to be somewhat pinched or kneaded in a manner resembling hand massage of this area. This kneading action is even more enhanced when the roller adjacent the head rest has the finger-like projections of latex material depicted in FIG. 11*c*.

That this kneading action may be accomplished, the user may begin pushing with his or her feet against the foot support 62 and then pulling the pair of handles 54 with his or her hands, with this combined action serving to produce a very helpful and stimulating neck and shoulder massage not readily obtained by merely manipulating the handles in the absence of frame movement.

I claim:

1. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with each of said rollers having a longitudinal axis about which it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface at such time as he is lying on the rollers, with the motion of the upper portions of said rollers during such back and forth movement of the frame on the supporting surface bringing about a massaging action to the portion of the user's body in contact with the rollers, at least one of said rollers being of significantly larger diameter than the other rollers of the array, said frame having a head end, adjacent which said larger diameter roller is operatively mounted so as to be contacted by the user's head, said larger diameter roller being employable by the user for head, neck and shoulder massage, separate mounting means being provided for said larger diameter roller, so that latter roller can be selectively moved by the user in a manner independent of the motion of all the other rollers of the array, said larger diameter roller being in rolling contact with the supporting surface.

2. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with each of said rollers having a longitudinal axis about which it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface at such time as he is lying on the rollers, with the motion of the upper portions of said rollers during such back and forth movement of the frame on the supporting surface bringing about a massaging action to the portion of the user's body in contact with the rollers, at least one of said rollers being of significantly larger diameter than the other rollers of the array, said frame having a head end, adjacent which said larger diameter roller is operatively mounted so as to be contacted by the user's head, said larger diameter roller being employable by the user for head, neck and shoulder massage, separate mounting means being provided for said larger diameter roller, said separate mounting means being independently pivoted upon said long sides of said elongate frame and involving a pair of handles, one located adjacent each end of said larger diameter roller, said handles being adapted to be grasped by the user and pulled substantially simultaneously in order to cause said larger diameter roller to move about its pivot point in a longitudinal direction along said frame, independent of any motion of the other rollers of said array, thus to bring about a desired massaging action on the head, neck and shoulders of the user.

3. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with each of said rollers having a longitudinal axis about which it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface at such time as he is lying on the rollers, with the motion of the upper portions of said rollers during such back and forth movement of the frame on the supporting surface bringing about a massaging action to the portion of the user's body in contact with the rollers, at least one of said rollers being of significantly larger diameter than the other rollers of the array, said frame having a head end, adjacent which said larger diameter roller is operatively mounted so as to be contacted by the user's head, said larger diameter roller being employable by the user for head, neck and shoulder massage, said elongate rollers being of generally cylindrical configuration and each of a length dimension at least twice its diameter, each of said elongate rollers having a mid portion of diminished diameter, such that when the user is lying supine in a substantially centered position on the rollers, undesirable contact with the spinal column of the user is avoided.

4. The back massage and exercise device as recited in claim 3 in which each of said rollers is of one-piece construction.

5. The back massage and exercise device as recited in claim 3 in which each of said rollers is covered with a sleeve of foam material.

6. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with each of said rollers having a longitudinal axis about which it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface at such time as he is lying on the rollers, with the motion of the upper portions of said rollers during such back and forth movement of the frame on the supporting surface bringing about a massaging action to the portion of the user's body in contact with the rollers, at least one of said rollers being of significantly larger diameter than the other rollers of the array, said frame having a head end, adjacent which said larger diameter roller is operatively mounted so as to be contacted by the user's head, said larger diameter roller being employable by the user for head, neck and shoulder massage, a head support member provided for utilization in conjunction with said larger diameter roller when said roller is being used in connection with head, shoulder and neck massage, said larger diameter roller being in direct rolling contact with the supporting surface, said head support member serving to prevent the user's head from moving too far backward during such massage.

7. The back massage and exercise device as recited in claim 6 in which said head support member is supported by a head frame, and means are provided for securing said head frame at a fixed distance adjacent said larger diameter roller.

8. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with each of said rollers having a longitudinal axis about which it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface at such time as he is lying on the rollers, with the motion of the upper portions of said rollers during such back and forth movement of the frame on the supporting surface bringing about a massaging action to the portion of the user's body in contact with the rollers, at least one of said rollers being of significantly larger diameter than the other rollers of the array, said frame having a head end, adjacent which said larger diameter roller is operatively mounted so as to be contacted by the user's head, said larger diameter roller being employable by the user for head, neck and shoulder massage, a head support member provided for utilization in conjunction with said larger diameter roller when said roller is being used in connection with head, shoulder and neck massage, said head support member serving to prevent the user's head from moving too far backward during such massage, said head support member comprising a head frame secured upon said long sides of said frame, in which head frame a movable carrier member having left and right sides is operatively supported, a taut, relatively wide elastic band extending between said left and right sides of said carrier member, and serving on occasion as a direct support for the user's head, means for normally biasing said carrier member to a location closely adjacent said larger diameter roller, so that subsequent to said carrier member being displaced by the motion of the user's head away from the location closely adjacent said larger diameter roller, said carrier member will tend to return to said closely adjacent location.

9. The back massage and exercise device as recited in claim 8 in which the bias by said biasing means is accomplished under the influence of gravity.

10. The back massage and exercise device as recited in claim 8 in which the bias by said biasing means is provided by the utilization of an elastic member.

11. The back massage and exercise device as recited in claim 8 in which the bias by said biasing means is provided by the combination of gravity and an elastic member.

12. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with said long sides of said frame having a spaced series of vertically disposed slots, each of said rollers having a longitudinal axis received in respective slots, about which axis it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface at such time as he is lying on the rollers, with the motion of the upper portions of said rollers during such back and forth movement of the frame on the supporting surface bringing about a massaging action to the portion of the user's body in contact with the rollers, at least one of said rollers being of significantly larger diameter than the other rollers of the array, said frame having a head end, adjacent which said larger diameter roller is operatively mounted so as to be contacted by the user's head, said larger diameter roller being employable by the user for head, neck and shoulder massage, support wheel means used at each end of said elongate frame for assuring a consistent spacing of said frame above the supporting surface, despite some vertical movement of said rollers in their respective vertically disposed slots.

13. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with each of said rollers having a longitudinal axis about which it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface at such time as he is lying on the rollers, with the motion of the upper portions of said rollers during such back and forth movement of the frame on the supporting surface bringing about a massaging action to the portion of the user's body in contact with the rollers, at least one of said rollers being of significantly larger diameter than the other rollers of the array, said frame having a head end, adjacent which said larger diameter roller is operatively mounted so as to be contacted by the user's head, said larger diameter roller being employable by the user for head, neck and shoulder massage, said elongate frame of rectangular configuration being utilized in combination with, and in a multimode manner on, an elongate support member utilized as the supporting surface, said elongate support member having guide means thereon for preventing said elongate frame from falling off of said elongate support member during back and forth movements of said elongate frame, said guide means involving a plurality of small wheels operatively engaging, and interacting with, at least one elongate groove.

14. The back massage and exercise device as recited in claim 13 in which a framework is provided for receiving said elongate support member, said-framework being configured such that said support member will reside at an angle of inclination, so that the head of the user lying on the elongate frame can be higher than his torso.

15. The back massage and exercise device as recited in claim 14 in which said framework is adjustable, such that the angle of inclination of said elongate support member can be adjusted.

16. The back massage and exercise device as recited in claim 13 in which spring means are attached to said elongate frame and to said elongate support member, said spring means serving to bias said elongate frame in a direction away from its head end.

17. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with said long sides of said frame having a spaced series of vertically disposed slots, each of said rollers having a longitudinal axis received in respective slots, about which axis it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface at such time as he is lying on the rollers, with the motion of the upper portions of said rollers during such back and forth movement of the frame on the supporting surface bringing about a massaging action to the portion of the user's body in contact with the rollers, at least one of said rollers being of significantly larger diameter than the other rollers of the array, said frame having a head end, adjacent which said larger diameter roller is operatively mounted so as to be contacted by the user's head, said larger diameter roller being employable by the user for head, neck and shoulder massage, said elongate frame of rectangular configuration utilizing rollers of substantially equal length, said frame being utilized in combination with, and in a multimode manner on an elongate support member, said support member having contoured edge portions, with the spacing of said edge portions being such as to contact and support the ends of said rollers of said frame, when said frame is placed upon said support member, the presence of said vertically disposed slots in said long sides making it possible for one roller to have a different heightwise position than the adjacent rollers.

18. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with each of said elongate rollers having a longitudinal axis about which it is freely rotatable, said frame having an operative position in which a lower portion of substantially all of said elongate rollers is in contact with the supporting surface, with an upper portion of said elongate rollers being available for directly supporting a human body, the user of said device being able to readily bring about back and forth rolling movement of said frame along the supporting surface at such time as he is lying on said elongate rollers, with the motion of the upper portions of said elongate rollers during such back and forth movement of the frame on the supporting surface bringing about a massaging action to the portion of the user's body in contact with said elongate rollers, at least one of said rollers being of significantly larger diameter than the elongate rollers of the roller array, said frame having a head end, adjacent which said larger diameter roller is operatively mounted so as to be contacted by the user's head, said larger diameter roller being employable by the user for head, neck and shoulder massage, said frame being utilized in combination with, and in a multimode manner on, an elongate support member, said support member being constituted by a base member having left and right side edges, said left and right side edges each defining a surface of undulating configuration, being represented by alternating peaks and valleys, with each elongate roller of the roller array being of sufficient length as to be in contact with both of said surfaces of undulating configuration, the elongate rollers in contact with such peaks when said frame is at a given location with respect to said support member being higher than the adjacent elongate rollers of the array.

19. The back massage and exercise device as recited in claim 18 in which both of said side edges of said support member are in a parallel relationship, with the peaks and valleys of one side in substantial alignment with the peaks and valleys of the other side, such that each roller of said roller array remains essentially parallel with the other rollers of the array during movement of said frame along said support member.

20. The back massage and exercise device as recited in claim 18 in which the peaks and valleys of one of said sides of said support member are in an out-of-phase relationship with the peaks and valleys of the other of said sides, such that each roller undertakes side-to-side tilting motion during movement of said frame along said support member.

21. A back massage and exercise device comprising a substantially flat, elongate frame of generally rectangular configuration able to be utilized on a supporting surface, said frame having a pair of long sides paired together by a pair of short sides and being several times as long as it is wide, a roller array in the form of a parallel series of elongate rollers loosely mounted in a spaced apart, operational relationship between the long sides of said frame, with each of said rollers having a longitudinal axis about which it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface at such time as he is lying on the rollers, with the motion of the upper portions of said rollers during such back and forth movement of the frame on the supporting surface bringing about a massaging action to the portion of the user's body in contact with the rollers, at least one of said rollers being of significantly larger diameter than the other rollers of the array, said frame having a head end, adjacent which said larger diameter roller is operatively mounted so as to be contacted by the user's head, said larger diameter roller being employable by the user for head, neck and shoulder massage, a leg elevating device utilized in conjunction with said elongate frame, latter device involving at least one roller designed to directly contact and support the user's legs and permit freedom of leg movement, the elevation of the user's legs as a result of the use of said leg elevating device bringing about a pelvic tilt serving to flatten the user's lumbar spine and thus facilitate the massage of the user's lower back area by the gentle movement of said rollers of said elongate frame as they help stretch the lower spine muscles of the user.

22. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with each of said rollers having a longitudinal axis about which it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface at such time as he is lying on the rollers, with the motion of the upper portions of said rollers during such back and forth movement of the frame on the supporting surface bringing about a massaging action to the portion of the user's body in contact with the rollers, at least one of said rollers being of significantly larger diameter than the other rollers of the array, said frame having a head end, adjacent which said larger diameter roller is operatively mounted so as to be contacted by the user's head, said larger diameter roller being employable by the user for head, neck and shoulder massage, said elongate frame of rectangular configuration being utilized on, and in combination with, an elongate support member, and a framework provided for receiving said elongate support member and for maintaining latter member at a location above the supporting surface, said framework having portions configured to receive said elongate support member in an angular relationship to the supporting surface, so that the head of the user lying on said elongate frame supported by said support member will be higher than his torso, said framework also having upper portions configured to have an overhead member available to be grasped by the hands of a user lying on said elongate frame, such that the user can utilize the pulling muscles of his arms for causing said elongate frame to roll up said angled support member.

23. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with each of said rollers having a longitudinal axis about which it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface at such time as he is lying on the rollers, with the motion of the upper portions of said rollers during such back and forth movement of the frame on the supporting surface bringing about a massaging action to the portion of the user's body in contact with the rollers, at least one of said rollers being of significantly larger diameter than the other rollers of the array, said frame having a head end, adjacent which said larger diameter roller is operatively mounted so as to be contacted by the user's head, said larger diameter roller being employable by the user for head, neck and shoulder massage, said elongate frame of rectangular configuration being utilized on, and in combination with, an elongate support member, and a framework is provided for receiving said elongate support member, said framework having portions configured to receive said elongate support member in a desired relationship to the supporting surface, leg elevation means mounted on said framework, roller means operatively mounted on said leg elevation means so as to be directly contacted by the legs of the user, thus making relative motion of the user's legs possible, and so that the legs of the user will be held higher than his torso when the user is lying on said elongate frame, the elevation of the user's legs as a result of the use of said leg elevation means bringing about a pelvic tilt serving to flatten the user's lumbar spine and thus facilitate the massage of the user's lower back area by the gentle movement of said rollers of said elongate frame as they help stretch the lower spine muscles of the user.

24. The back massage and exercise device as recited in claim 23 in which spring means are attached to the end of said elongate frame remote from the head end thereof, said spring means forming a desirable amount of resistance to said elongate frame rolling up said elongate support member.

25. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with each of said rollers having a longitudinal axis about which it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface in the direction of its long dimension at such time as the user is lying on the rollers, with the motion of the upper portions of said rollers during such back and forth movement of the frame bringing about a massaging action to the portion of the user's body in contact with the rollers, and an elongate support member forming said supporting surface, said support member having on its upper surface at least one pair of elongate grooves disposed in a parallel relationship and extending at least a part of the long dimension of said support member, and at least one pair of relatively small support wheels mounted on the underside of said frame, with the spacing of said support wheels being such as to permit said support wheels to operatively engage said grooves, whereby said grooves serve as guide means for guiding the back and forth movements of said frame along said support member.

26. A back massage and exercise device as defined in claim 25 in which said elongate support member is mounted on a framework, and adjustment means on said framework for enabling the angle of inclination of said elongate support member with respect to the supporting surface to be altered at behest of the user.

27. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with each of said rollers having a longitudinal axis about which it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface in the direction of its long dimension at such time as the user is lying on the rollers, with the motion of the upper portions of said rollers during such back and forth movement of the frame bringing about a massaging action to the portion of the user's body in contact with the rollers, and an elongate support member forming said supporting surface, said support member having on its upper surface at least one pair of elongate grooves disposed in a parallel relationship and extending at least a part of the long dimension of said support member, and at least one pair of relatively small support wheels mounted on the underside of said frame, with the spacing of said support wheels being such as to permit said support wheels to operatively engage said grooves, whereby said grooves serve as guide means for guiding the back and forth movements of said frame along said support member, a leg elevating device utilized in conjunction with said elongate frame, latter device involving at least one roller designed to directly contact and support the user's legs and permit freedom of leg movement, the elevation of the user's legs as a result of the use of said leg elevating device bringing about a pelvic tilt serving to flatten the user's lumbar spine and thus facilitate the massage of the user's lower back area by the gentle movement of said rollers of said elongate frame as they help stretch the lower spine muscles of the user.

28. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate rollers loosely mounted in a spaced apart, operational relationship between the long sides of said frame, with each of said rollers having a longitudinal axis about which it is freely rotatable, said frame having an operative position in which a lower portion of substantially all of said rollers is in contact with the supporting surface, with an upper portion of said rollers being available for directly supporting a human body, the user of said device being able to readily bring about back and forth rolling movement of said frame along the supporting surface in the direction of its long dimension at such time as the user is lying on the rollers, with the motion of the upper portions of said rollers during such back and forth movement of the frame bringing about a massaging action to the portion of the user's body in contact with the rollers, and an elongate support member forming said supporting surface, said support member having on its upper surface at least one pair of elongate grooves disposed in a parallel relationship and extending at least a part of the long dimension of said support member, and at least one pair of relatively small support wheels mounted on the underside of said frame, with the spacing of said support wheels being such as to permit said support wheels to operatively engage said grooves, whereby said grooves serve as guide means for guiding the back and forth movements of said frame along said support member, said support member being constituted by a base member having left and right side edges, said left and right side edges each defining a surface of undulating configuration, being represented by alternating peaks and valleys, with each roller of the roller array being of sufficient length as to be in contact with both of said surfaces of undulating configuration, the rollers in contact with such peaks when said frame is at a given location with respect to said support member being higher than the other rollers of the array.

29. The back massage and exercise device as recited in claim 27 in which both of said side edges of said support member are in a parallel relationship, with the peaks and valleys of one side in substantial alignment with the peaks and valleys of the other side, such that each roller of said roller array remains essentially parallel with the other rollers of the array during movement of said frame along said support member.

30. The back massage and exercise device as recited in claim 28 in which the peaks and valleys of one of said sides of said support member are in an out-of-phase relationship with the peaks and valleys of the other of said sides, such that each roller undertakes side-to-side tilting motion during movement of said frame along said support member.

31. The back massage and exercise device as recited in claim 27 in which a component on one of the long sides of said frame can be loosened, such that at least some of the rollers of said roller array can be removed from the frame, and rollers of a different size or characteristic substituted.

32. The back massage and exercise device as recited in claim 27 in which said elongate rollers are of generally cylindrical configuration and each of a length dimension at least twice its diameter.

33. A back massage and exercise device comprising a substantially flat, elongate frame of generally rectangular configuration able to be utilized on a supporting surface, said frame having a pair of long sides joined together by a pair of short sides and being several times as long as it is wide, a roller array in the form of a parallel series of elongate, generally cylindrical rollers loosely mounted in a spaced apart, operational relationship between the long sides of said elongate frame, with each of said rollers having a longitudinal axis about which it is freely rotatable, said elongate frame having an operative position in which a lower portion of substantially all of said rollers is in contact with the supporting surface, with an upper portion of said rollers being available for directly supporting a human body, the user of said elongate frame being able to readily bring about back and forth rolling movement of said elongate frame along the supporting surface in the direction of its long dimension at such time as he is lying on the rollers, with the motion of the upper portions of said rollers during such back and forth movement of said elongate frame bringing about a massaging action to the portion of the user's body in contact with the rollers, and a leg elevating device utilized in conjunction with said elongate frame, the elevation of the user's legs resulting from the use of said leg elevating device bringing about a pelvic tilt serving to flatten the user's lumbar spine and thus facilitate the massage of the user's lower back area by the gentle movement of said rollers of said elongate frame as they help stretch the lower spine muscles of the user, said leg elevating device involving the use of at least one set of leg-contacting roller devices.

34. The back massage and exercise device as recited in claim 33 in which said leg-contacting roller devices are hingedly mounted on a supporting framework so as to be movable between out-of-use positions and active positions.

35. The back massage and exercise device as recited in claim 33 in which said parallel series of elongate, generally cylindrical rollers are each of a length dimension at least twice its diameter.

36. A back massage and exercise device comprising a substantially flat, elongate frame of generally rectangular configuration able to be utilized on a supporting surface, said frame having a pair of long sides joined by a pair of short sides and being several times as long as it is wide, a series of vertically disposed slots arranged in a spaced relationship along each of said long sides of said frame, with the slots in one long side being in alignment with the slots in the other long side, a roller array constituted by a series of elongate rollers operatively mounted in a loose relationship in said slots, with each of said rollers having a longitudinal axis about which it is rotatable, and with a support shaft protruding for a limited extent from each end of each roller, each support shaft being disposed along the longitudinal axis of the roller, and each support shaft extending through a respective slot of said frame, said slots, because of being disposed vertically, permitting one roller to have a different heightwise position than adjacent rollers, said frame having an operative position in which a lower portion of substantially all of said rollers are in contact with the supporting surface, with an upper portion of said rollers being available for directly supporting a human body, and a handle on each side of said elongate frame, to be grasped by a user in enabling said elongate frame to be moved in a back and forth manner on the supporting surface at such time as the user is lying on the rollers, with the motion of the upper portions of said rollers during rolling movement of said elongate frame bringing about a massaging action upon the portion of the user's body in contact with the rollers.

37. The back massage and exercise device as recited in claim 36 in which each of said handles is formed by an extension of one of said support shafts.

38. The back massage and exercise device as recited in claim 36 in which said support shaft of each roller is a steel axle about which the roller is rotatable, said handles being mounted on the outer ends of one of said steel axles.

39. The back massage and exercise device as recited in claim 36 in which a component on one of the long sides of said frame can be loosened, such that at least some of the rollers of said roller array can be removed from the frame, and rollers of a different size or characteristic substituted.

40. The back massage and exercise device as recited in claim 36 in which each of said elongate rollers has a mid portion of reduced diameter, such that when the user is lying supine in a substantially centered position on the rollers, the vertebra constituting the user's spinal column are not in direct contact with any of the rollers.

41. The back massage and exercise device as recited in claim 36 in which support wheels of fixed height are used at each end of said frame of rectangular configuration, to assure a consistent spacing of said frame above the supporting surface.

42. The back massage and exercise device as recited in claim 36 in which at least one of said rollers is of significantly larger diameter than the other rollers of the array, said elongate frame having a head end, adjacent which the head of the user is to be placed, with said larger diameter roller being rotatably mounted at a location adjacent said head end of said frame, and employable by the user for head, neck and shoulder massage.

43. The back massage and exercise device as recited in claim 42 in which separate mounting means are provided for said larger diameter roller, so that latter roller can be selectively moved by the user in a manner independent of the motion of all the other rollers of the array.

44. The back massage and exercise device as recited in claim 42 in which separate mounting means are provided for said larger diameter roller, said separate mounting means being independently pivoted and involving a pair of handles, one handle located adjacent each end of said larger diameter roller, said handles being adapted to be grasped by the user and pulled substantially simultaneously in order to cause said larger diameter roller to move about its pivot point in a longitudinal direction along said frame, independent of the motion of any other rollers of said array, thus to bring about a desired massaging action on the head, neck and shoulders of the user.

45. The back massage and exercise device as recited in claim 42 in which a head support member is provided for utilization in conjunction with said larger diameter roller when said roller is being used in connection with head, shoulder and neck massage, said head support member comprising a head frame secured upon said long sides of said frame, in which head frame a movable carrier member having left and right sides is operatively supported, a taut elastic band extending between said left and right sides of said carrier member, and serving on occasion as a direct support for the user's head, means for normally biasing said carrier member to a location closely adjacent said larger diameter roller, so that subsequent to said carrier member being displaced by the motion of the user's head away from the location closely adjacent said larger diameter roller, said carrier member will tend to return to said closely adjacent location.

46. The back massage and exercise device as recited in claim 45 in which the bias by said biasing means is accomplished under the influence of gravity.

47. The back massage and exercise device as recited in claim 45 in which the bias by said biasing means is provided by the utilization of an elastic member.

48. The back massage and exercise device as recited in claim 45 in which the bias by said biasing means is provided by the combination of gravity and an elastic member.

49. The back massage and exercise device as recited in claim 36 in which said elongate frame of rectangular configuration is operatively mounted on a support member of elongate configuration, means forming an inclined surface upon which said support member is operatively mounted for movement along its longitudinal axis.

50. The back massage and exercise device as recited in claim 49 in which spring means are attached to said elongate frame and to said elongate support member, said spring means serving to bias said elongate frame in a direction away from its head end.

51. The back massage and exercise device as recited in claim 49 in which a framework is provided for receiving said support member, said framework being configured such that said support member caused to reside at a selected angle, so that the head of the person lying on the elongate frame can be higher than his torso.

52. The back massage and exercise device as recited in claim 36 in which said elongate frame of rectangular configuration utilizes rollers of substantially equal length, said elongate frame being operatively mounted in a multimode manner on a support member of elongate configuration, said support member having contoured edge portions, with the spacing of said edge portions being such as to contact and support the ends of said rollers of said frame, when said frame is placed upon said support member.

53. The back massage and exercise device as recited in claim 36 in which said elongate rollers are of generally cylindrical configuration and each of a length dimension at least twice its diameter.

54. A back massage and exercise device comprising a substantially flat, elongate frame of generally rectangular configuration able to be utilized on a supporting surface, said frame having a pair of long side members joined together by short side members defining a head end and a tail end, and being several times as long as it is wide, a series of vertically disposed slots arranged in a spaced relationship along each of said long side members of said frame, with the slots in one long side member being in alignment with the slots in the other long side member, an array of elongate rollers operatively mounted in a loose relationship in said slots, each of said rollers having a longitudinal axis about which it is rotatable, with a support shaft protruding for a limited extent from each end of each roller, each support shaft being disposed along the longitudinal axis of the roller, and each support shaft extending through a respective slot of said frame, said slots, because of being disposed vertically, permitting one roller to have a different heightwise position than adjacent rollers, fixed height wheel means at each end of said frame, for supporting said frame a consistent distance above the supporting surface, said frame having an operative position in which a lower portion of substantially all of said rollers is in contact with the supporting surface, with an upper portion of said rollers being available for directly supporting a human body, the user of said device being able to readily bring about back and forth longitudinal movement of said frame along the supporting surface at such time as he is lying on the rollers, with the motion of the upper portions of said rollers during rolling movement of said frame along the supporting surface bringing about a massaging action to the portion of the user's body in contact with the rollers of said roller array, a large roller rotatably mounted near said head end of said elongate frame, for use during head, neck and shoulder massage, and a head supporting member mounted adjacent said large roller, said head supporting member being mounted for movement in accordance with movements of the head as the body of the user moves back and forth along the roller array, said head supporting member preventing undesirable rearward head motion during such head, neck and shoulder massage.

55. The back massage and exercise device as recited in claim 54 in which said elongate rollers are of generally cylindrical configuration and each of a length dimension at least twice its diameter.

56. The back massage and exercise device as recited in claim 54 in which said elongate frame is operatively mounted on, and used in combination with, a support member of elongate configuration, said support member being constituted by a base member having left and right sides, said left and right sides each having surfaces of an undulating configuration, being represented by alternating peaks and valleys, with each roller of said roller array being of sufficient length to be in contact with said surfaces of undulating configuration, the rollers in contact with such peaks when said frame is at a given location with respect to said support member being higher than the other rollers of the array.

57. The back massage and exercise device as recited in claim 56 in which said both sides of said support member are in a parallel relationship, with the peaks and valleys of one side in alignment with the peaks and valleys of the other side, such that each roller remains essentially parallel with the other rollers of the array during movement of said frame along said support member.

58. The back massage and exercise device as recited in claim 56 in which the peaks and valleys of one of said sides of said support member are positioned in an out-of-phase relationship with the peaks and valleys of the other of said sides, such that each roller undertakes side-to-side tilting motion during movement of said frame along said support member.

* * * * *